US007306495B2

(12) United States Patent
Hashimoto et al.

(10) Patent No.: US 7,306,495 B2
(45) Date of Patent: Dec. 11, 2007

(54) TERMINAL CRIMPING STRUCTURE AND TERMINAL CRIMPING METHOD ONTO ALUMINUM ELECTRIC-WIRE AND PRODUCING METHOD OF ALUMINUM ELECTRIC-WIRE WITH TERMINAL

(75) Inventors: Toshiyuki Hashimoto, Chiyoda-ku (JP); Shuhei Kaneko, Chiyoda-ku (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 10/880,666

(22) Filed: Jul. 1, 2004

(65) Prior Publication Data

US 2005/0026515 A1 Feb. 3, 2005

(30) Foreign Application Priority Data

| | | |
|---|---|---|
| Jul. 30, 2003 | (JP) | 2003-283237 |
| Nov. 20, 2003 | (JP) | 2003-390124 |
| Apr. 16, 2004 | (JP) | 2004-121051 |

(51) Int. Cl.
*H01R 4/10* (2006.01)

(52) U.S. Cl. ..... 439/877

(58) Field of Classification Search ..... 439/877
See application file for complete search history.

(56) References Cited

U.S. PATENT DOCUMENTS 2,535,013 A * 12/1950 Freedom ..... 439/877
2,815,497 A 12/1957 Redslob
5,499,448 A 3/1996 Tournier et al.

FOREIGN PATENT DOCUMENTS

| | | |
|---|---|---|
| DE | 1 097 504 | 4/1954 |
| DE | 200 08 544 U1 | 8/2000 |
| JP | 06-36215 | 5/1994 |
| JP | 06-36216 | 5/1994 |
| JP | 3005065 | 9/1994 |
| JP | 11-297375 | 10/1999 |

* cited by examiner

*Primary Examiner*—Briggitte R. Hammond
(74) *Attorney, Agent, or Firm*—Oblon, Spivak, McClelland, Maier & Neustadt, P.C.

(57) ABSTRACT

A terminal crimping structure onto aluminum electric-wire, for crimping a terminal onto an aluminum electric-wire including: an electrical conductor part comprising numerous strands; and a coating part coated on the . electrical conductor part; wherein the terminal has a wire barrel to be crimped onto the electrical conductor part of the aluminum electric-wire; and wherein the compressed ratio of the aluminum electric-wire's conductor part by the wire barrel is within a range of 50 to 70%, in terms of the ratio of (cross-sectional area of aluminum electric-wire's conductor part at crimped portion)/(cross-sectional area of aluminum electric-wire's conductor part before crimping).

10 Claims, 24 Drawing Sheets

<Related Art>

<Related Art>

<Related Art>

TERMINAL CRIMPING STRUCTURE AND TERMINAL CRIMPING METHOD ONTO ALUMINUM ELECTRIC-WIRE AND PRODUCING METHOD OF ALUMINUM ELECTRIC-WIRE WITH TERMINAL

BACKGROUND

1. Field of the Invention

The present invention relates to a terminal crimping structure and a terminal crimping method onto aluminum electric-wire, the terminal being used to be crimped onto the aluminum electric-wire and mounted within a connector housing, and relates to a producing method of an aluminum electric-wire with a terminal.

2. Description of the Related Art

There will be firstly described an object of the present invention. Conventionally, wire harnesses such as arranged within vehicular compartments have been typically made of copper electric-wires, and it has been rare to use aluminum electric-wires having deteriorated properties (physical properties) such as electric conductivity and strength. However, there have been recently increased such demands for using aluminum electric-wires, so as to reduce weights of vehicles and in view of recycling ability of the aluminum electric-wires. Meanwhile, electrical connectors have been typically used to connect wire harnesses to each other or to connect an in-vehicle equipment to a wire harness. Such electrical connectors are constituted of: connector housings to be fitted to each other; and multiple crimping terminals, to be inserted into and fitted to the connector housings, and crimpedly connected to electric-wires of wire harnesses; respectively.

Shapes of crimping portions of terminal metal-fittings constituting the crimping terminals include two types, opened barrel and closed barrel, and the former type is generally used from a standpoint of improved operability. Further, the compressed ratio (also called a surface-area reducing ratio, and hereinafter simply called "compressed ratio") to be defined by a ratio of (cross-sectional area of electric-wire's conductor part at crimped portion)/(cross-sectional area of electric-wire's conductor part before crimping), is determined from such standpoints that the contact resistance is to be within a stability region, disconnection of electric-wire is not to be caused due to vibrations, and a sufficient fixing force to the electric-wire is to be achieved.

Note that compressed ratios of cross-sections of electric-wire's conductors upon crimping terminals are presently defined and controlled to be within a range of 75% to 95%, though such ratios are slightly changed depending on manufacturers, electric-wire sizes and the like (see Patent Document 1, for example).

Patent Document 1: Japanese Registered Utility Model No. 3005065 (pages 5-6, FIG. 6).

In conventional terminal crimping methods, terminals have been crimped onto copper electric-wire's conductor parts at the above-mentioned compressed ratios. Even when terminals are crimped onto copper electric-wires at such compressed ratios, the terminals are allowed to be connected to the copper electric-wires without any particular problems by virtue of the mechanical characteristics and electric characteristics of the copper electric-wires, so that the copper electric-wires connected with such terminals can be directly used without any inconvenience.

However, aluminum electric-wires have melting temperatures lower than those of copper electric-wires, and each of strands constituting an aluminum electric-wire is more apt to form an oxide film. Thus, electric current is flowed through limited strands to thereby easily cause a constriction resistance which in turn leads to a risk of: occurrence of melting; and defective conduction.

When aluminum electric-wires are actually crimped with terminals under the same conditions as copper electric-wires, resistances at terminal-crimped portions are increased due to environmental variations such as raised or lowered temperatures to thereby cause defects of conduction, thereby failing to maintain electric connecting states at satisfactory levels between terminals and electric-wires. As such, it is inappropriate to perform the crimping at the above-mentioned compressed ratios, insofar as concerned with a terminal crimping structure onto aluminum electric-wire.

There will be explained hereinafter another object of the present invention. In this explanation, there will be described a crimping process in a situation for crimping a terminal onto an aluminum electric-wire by way of experiment, based on a terminal crimping structure for copper electric-wire. FIG. 1 shows a conventional terminal to be crimped onto a copper electric-wire. As shown in FIG. 1, the terminal 580 is constituted of an inter-terminal connecting portion 580*a* and an electric-wire connecting portion 580*b*, and the electric-wire connecting portion 580*b* is constituted of: a pair of wire barrel pieces 581 each having a certain length in a terminal-wise longitudinal direction; and a pair of insulation barrel pieces 585 neighbored to the wire barrel pieces and crimped onto a coating part of the copper electric-wire. FIG. 2 is an explanatory view of a process for crimping such a terminal 580 onto an aluminum electric-wire 501 instead of a copper electric-wire. As apparent from this figure upon crimping the terminal, there is used a crimping jig 680 provided with terminal crimping portions 681, 685 corresponding to the wire barrel pieces 581 and insulation barrel pieces 585 of the terminal 580, respectively. Note that, when viewed in a longitudinal direction of a terminal to be crimped, the crimping jig 680 is formed with crimping grooves each having an inverted "V" shape as a whole and having an "M" shape at an apex of the inverted "V" shape for curling the tip ends of the barrel pieces in the caulking direction. Further, such a crimping jig 680 is downwardly moved from the above of the terminal 580 (see an arrow X showing a terminal crimping direction in the figure), thereby deforming the barrel pieces 581, 585 of the terminal 580 along the groove surfaces in the inverted "V" shapes of the jig 680 (see FIG. 2B and FIG. 2C). Since each groove surface in the inverted "V" shapes of the jig 680 has its tip end in the "M" shape, further urging the jig 680 toward the terminal 580 causes the end portions of the barrel pieces 581, 585 to be curled toward the aluminum electric-wire 501 in the direction for caulking the barrel tip ends, respectively. This crimps the barrel pieces 581, 585 onto an electrical conductor part 501*a* and a coating part 501*b* of the aluminum electric-wire 501 (see FIG. 2C and FIG. 3A), respectively. When the terminal 580 is firmly crimped onto the aluminum electric-wire 501, the crimping jig 680 is raised in a Y direction in the figure, thereby completing the terminal crimping process.

Note that those terminals are also known which have such structures each including a wire barrel which is not constituted of a pair of barrel pieces as in the terminal 580 but constituted of multiple pairs of barrel pieces (see Patent Document 2 through Patent Document 4).

Patent Document 2: JP-U-6-36215 (pages 4-5, FIG. 2)

Patent Document 3: JP-U-6-36216 (pages 4-5, FIG. 2)

Patent Document 4: JP-A-11-297375 (pages 3-4, FIG. 1)

Next, there will be explained a further object of the present invention.

In the method for connecting copper electric-wires and terminals to each other, although the terminal 580 is not contacted with all of the strands constituting the copper electric-wire, the terminal has been allowed to be connected to the copper electric-wire without any particular problems by virtue of the mechanical characteristics and electric characteristic of the copper electric-wire.

However, aluminum electric-wires have weaker mechanical strengths and lower melting temperatures as compared with copper electric-wires, and have such properties that each of the strands constituting the aluminum electric-wire is apt to form an oxide film. Thus, electric current is flowed through limited strands to thereby easily cause a constriction resistance which in turn leads to a risk of: occurrence of melting; and defective conduction.

Concretely, when the terminal is strongly crimped onto an aluminum electric-wire to such an extent that oxide films of strands are broken and the strands themselves and the strands and wire barrel pieces are extremely closely contacted with each other, the crimped structure is allowed to withstand an environmental test such as thermal cycles insofar as concerned with an electric conducting property. However, the electric-wire retaining force is extremely deteriorated due to the excessive stress affecting the terminal-crimped portion, thereby possibly resulting in an inappropriate connecting structure when used between a terminal and an electric-wire.

FIG. 3 shows a state where the terminal 580 is crimped onto such an aluminum electric-wire 501, by a plan view (FIG. 3A) and a side view (FIGS. 3B, C). Note that, when viewed in a terminal crimping direction in FIG. 3B, the crimped portions of the wire barrel pieces 581 have the same heights as those in the crimping of a conventional copper electric-wire, relative to the electrical conductor part 501*a* of the aluminum electric-wire 501 (see height He in the drawing). Further, FIG. 3C shows a state where the terminal 580 is crimped at a compressed ratio (surface-area reducing ratio) higher than that in FIG. 3B so that the terminal 580 has a height (see height Hf in the drawing) lower than FIG. 3B when viewed in a terminal crimping direction.

In the crimped state shown in FIG. 3B which is the same as the conventional copper electric-wire, although the terminal crimping strength (electric-wire retaining force) is not problematic, oxide films on the surfaces of the strands of the electrical conductor part 501*a* are not sufficiently broken, and there is caused an increased contact resistance in an environmental test such as thermal cycles, thereby resulting in an insufficient electric conducting property. Meanwhile, when the terminal 580 is crimped onto the aluminum electric-wire 501 at a higher compressed ratio (surface-area reducing ratio) as shown in FIG. 3C, electric conduction is certainly and sufficiently achieved, but the electric-wire retaining force is deteriorated due to the increased stress affecting the terminal-crimped portion of the electric-wire, thereby failing to obtain a terminal crimping strength required for each electric-wire size.

Note that each of the terminals described in the Patent Document 2 through Patent Document 4 has a constitution formed with multiple pairs of wire barrel pieces in addition to a pair of insulation barrel pieces. However, the pairs of wire barrel pieces are individually formed so as to correspond to different diameters of crimping-targeted electric-wires, respectively, and there is never disclosed such a constitution to crimp a terminal onto an electrical conductor part of an aluminum electric-wire having a certain diameter, simultaneously at different compressed ratios (surface-area reducing ratios) by the pairs of wire barrel pieces, respectively.

SUMMARY

It is therefore an object of the present invention to provide a terminal crimping structure and a terminal crimping method onto aluminum electric-wire as well as a producing method of an aluminum electric-wire with a terminal, for allowing electric characteristics of connected portions to be maintained irrespectively of an environmental change, upon crimping the terminal onto the aluminum electric-wire.

It is a further object of the present invention to provide a terminal structure having a necessary terminal crimping strength (electric-wire retaining force of the terminal) while ensuring a sufficient electric conducting property between the aluminum electric-wire and the terminal, upon crimping the terminal onto the aluminum electric-wire.

To achieve the above object, claim 1 of the present invention recites a terminal crimping structure onto aluminum electric-wire, for crimping a terminal onto an aluminum electric-wire including: an electrical conductor part comprising numerous strands; and a coating part coated on the electrical conductor part; characterized in that the terminal has a wire barrel to be crimped onto the electrical conductor part of the aluminum electric-wire; and that the compressed ratio of the aluminum electric-wire's conductor part by the wire barrel is within a range of 50 to 70%, in terms of the ratio of (cross-sectional area of aluminum electric-wire's conductor part at crimped portion)/(cross-sectional area of aluminum electric-wire's conductor part before crimping).

Further, claim 2 of the present invention recites a terminal crimping structure onto aluminum electric-wire, for crimping a terminal onto an aluminum electric-wire including: an electrical conductor part comprising numerous strands; and a coating part coated on the electrical conductor part; characterized in that the terminal has a wire barrel to be crimped onto the electrical conductor part of the aluminum electric-wire; and that the cross-sectional area of the aluminum electric-wire's conductor part to be crimped is 1.5 $mm^2$ or more, and the compressed ratio of the aluminum electric-wire's conductor part by the wire barrel is within a range of 40 to 70%, in terms of the ratio of (cross-sectional area of aluminum electric-wire's conductor part at crimped portion)/(cross-sectional area of aluminum electric-wire's conductor part before crimping).

Additionally, claim 3 of the present invention recites a terminal crimping structure onto aluminum electric-wire, for crimping a terminal onto an aluminum electric-wire including: an electrical conductor part comprising numerous strands; and a coating part coated on the electrical conductor part; characterized in that the terminal has a wire barrel to be crimped onto the electrical conductor part of the aluminum electric-wire; and that the cross-sectional area of the aluminum electric-wire's conductor part to be crimped is 1.5 $mm^2$ or more, and the compressed ratio of the aluminum electric-wire's conductor part by the wire barrel has an upper limit value of 70% in terms of the ratio of the (cross-sectional area of aluminum electric-wire's conductor part at crimped portion)/(cross-sectional area of aluminum electric-wire's conductor part before crimping), and a lower limit value where the terminal crimping strength becomes 100N.

Furthermore, claim 4 of the present invention recites a terminal crimping method onto aluminum electric-wire, for crimping a terminal onto an aluminum electric-wire including: an electrical conductor part comprising numerous strands; and a coating part coated on the electrical conductor part; characterized in that the method comprises the steps of: preparing the aluminum electric-wire; preparing the terminal having a wire barrel to be crimped onto the electrical conductor part of the aluminum electric-wire; and crimping the terminal onto the aluminum electric-wire such that the compressed ratio of the aluminum electric-wire's conductor part by the wire barrel falls within a range of 50 to 70%, in terms of the ratio of (cross-sectional area of aluminum electric-wire's conductor part at crimped portion)/(cross-sectional area of aluminum electric-wire's conductor part before crimping).

Moreover, claim 5 of the present invention recites a terminal crimping method onto aluminum electric-wire, for crimping a terminal onto an aluminum electric-wire including: an electrical conductor part comprising numerous strands; and a coating part coated on the electrical conductor part; characterized in that the method comprises the steps of: preparing the aluminum electric-wire in which the electrical conductor part to be crimped has a cross-sectional area of 1.5 $mm^2$ or more, and preparing the terminal having a wire barrel to be crimped onto the electrical conductor part of the aluminum electric-wire; and crimping the terminal onto the aluminum electric-wire such that the compressed ratio of the aluminum electric-wire's conductor part by the wire barrel falls within a range of 40 to 70%, in terms of the ratio of (cross-sectional area of aluminum electric-wire's conductor part at crimped portion)/(cross-sectional area of aluminum electric-wire's conductor part before crimping).

Furthermore, claim 6 of the present invention recites a terminal crimping method onto aluminum electric-wire, for crimping a terminal onto an aluminum electric-wire including: an electrical conductor part comprising numerous strands; and a coating part coated on the electrical conductor part; characterized in that the method comprises the steps of: preparing the aluminum electric-wire in which the electrical conductor part to be crimped has a cross-sectional area of 1.5 $mm^2$ or more, and preparing the terminal having a wire barrel to be crimped onto the electrical conductor part of the aluminum electric-wire; and crimping the terminal onto the aluminum electric-wire such that the compressed ratio of the aluminum electric-wire's conductor part by the wire barrel has an upper limit value of 70% in terms of the ratio of the (cross-sectional area of aluminum electric-wire's conductor part at crimped portion)/(cross-sectional area of aluminum electric-wire's conductor part before crimping), and a lower limit value where the terminal crimping strength becomes 100N.

Controlling the compressed ratio of the aluminum electric-wire based on the above described upper limit value makes it possible to maintain a stable electric connection without causing a resistance increase of the aluminum electric-wire with terminal in an environmental test for exposing a test target to high temperatures and low temperatures.

Further, controlling the compressed ratio of the aluminum electric-wire based on the above described lower limit value avoids a considerable deterioration of crimping strength of the aluminum electric-wire. This prevents occurrence of mechanical damages such as electric-wire breakage at the crimped aluminum electric-wire portion.

Note that, in case where the cross-sectional area of the aluminum electric-wire's conductor part is 1.5 $mm^2$ or more, the crimping strength of the aluminum electric-wire is not considerably deteriorated even when the compressed ratio is controlled based on the above described lower limit value. This prevents occurrence of mechanical damages such as electric-wire breakage at the crimped aluminum electric-wire portion.

Meanwhile, claim 7 of the present invention recites a producing method of aluminum electric-wire with terminal, for crimping a terminal onto an aluminum electric-wire including: an electrical conductor part comprising numerous strands; and a coating part coated on the electrical conductor part; to thereby produce the aluminum electric-wire with terminal, characterized in that the method comprises the steps of: preparing the aluminum electric-wire, and preparing the terminal having a wire barrel to be crimped onto the electrical conductor part of the aluminum electric-wire; and crimping the terminal onto the aluminum electric-wire such that the compressed ratio of the aluminum electric-wire's conductor part by the wire barrel falls within a range of 50 to 70%, in terms of the ratio of (cross-sectional area of aluminum electric-wire's conductor part at crimped portion)/(cross-sectional area of aluminum electric-wire's conductor part before crimping), to thereby produce the aluminum electric-wire with terminal.

Further, claim 8 of the present invention recites a producing method of aluminum electric-wire with terminal, for crimping a terminal onto an aluminum electric-wire including: an electrical conductor part comprising numerous strands; and a coating part coated on the electrical conductor part; to thereby produce the aluminum electric-wire with terminal, characterized in that the method comprises the steps of: preparing the aluminum electric-wire in which the electrical conductor part to be crimped has a cross-sectional area of 1.5 $mm^2$ or more, and preparing the terminal having a wire barrel to be crimped onto the electrical conductor part of the aluminum electric-wire; and crimping the terminal onto the aluminum electric-wire such that the compressed ratio of the aluminum electric-wire's conductor part by the wire barrel falls within a range of 40 to 70%, in terms of the ratio of (cross-sectional area of aluminum electric-wire's conductor part at crimped portion)/(cross-sectional area of aluminum electric-wire's conductor part before crimping), to thereby produce the aluminum electric-wire with terminal.

Moreover, claim 9 of the present invention recites a producing method of aluminum electric-wire with terminal, for crimping a terminal onto an aluminum electric-wire including: an electrical conductor part comprising numerous strands; and a coating part coated on the electrical conductor part; to thereby produce the aluminum electric-wire with terminal, characterized in that the method comprises the steps of: preparing the aluminum electric-wire in which the electrical conductor part to be crimped has a cross-sectional area of 1.5 $mm^2$ or more, and preparing the terminal having a wire barrel to be crimped onto the electrical conductor part of the aluminum electric-wire; and crimping the terminal onto the aluminum electric-wire such that the compressed ratio of the aluminum electric-wire's conductor part by the wire barrel has an upper limit value of 70% in terms of the ratio of the (cross-sectional area of aluminum electric-wire's conductor part at crimped portion)/(cross-sectional area of aluminum electric-wire's conductor part before crimping), and a lower limit value where the terminal crimping strength becomes 100N, to thereby produce the aluminum electric-wire with terminal.

Producing such an aluminum electric-wire with terminal makes it possible to maintain a stable electric connection without causing a resistance increase of the aluminum electric-wire in an environmental test requiring high temperatures and low temperatures, and to obtain an aluminum electric-wire with terminal which never causes mechanical damages such as electric-wire breakage at the crimped electric-wire portion.

Further, claim 10 of the present invention recites a terminal crimping structure onto aluminum electric-wire, for crimping a terminal comprising: an aluminum-electric-wire's coating part crimping insulation barrel; as well as an aluminum-electric-wire conducting crimp barrel and an aluminum-electric-wire retaining crimp barrel; onto an aluminum electric-wire; characterized in that the aluminum-electric-wire conducting crimp barrel and the aluminum-electric-wire retaining crimp barrel are formed integrally with each other as a wire barrel, the region of the wire barrel having a smaller height corresponds to the aluminum-electric-wire conducting crimp barrel and the region of the wire barrel having a larger height corresponds to the aluminum-electric-wire retaining crimp barrel, when viewed in the terminal crimping direction in the state where the terminal is crimped.

In this way, the terminal retains the aluminum electric-wire at the same compressed ratio (surface-area reducing ratio) as the conventional copper electric-wire in the crimped terminal region having the larger height corresponding to the aluminum-electric-wire retaining crimp barrel, and is crimped onto the aluminum electric-wire at a higher compressed ratio (surface-area reducing ratio) in the region having the smaller height corresponding to the aluminum-electric-wire conducting crimp barrel so as to break the insulative oxide film of strands and so as to be closely contacted therewith, so that the terminal can be crimped while ensuring an electric conducting property.

Meanwhile, claim 11 of the present invention recites the terminal crimping structure onto aluminum electric-wire of claim 10, characterized in that, after the terminal is crimped, the compressed ratio of the aluminum electric-wire's conductor part in the region of the wire barrel having the smaller height is within a range of 50 to 70%, in terms of the ratio of (cross-sectional area of aluminum electric-wire's conductor part at crimped portion)/(cross-sectional area of aluminum electric-wire's conductor part before crimping).

Further, claim 12 of the present invention recites the terminal crimping structure onto aluminum electric-wire of claim 10, characterized in that the cross-sectional area of the aluminum electric-wire's conductor part to be crimped with the aluminum-electric-wire conducting crimp barrel is 1.5 $mm^2$ or more, and, after the terminal is crimped, the compressed ratio of the aluminum electric-wire's conductor part in the region of the wire barrel having the smaller height is within a range of 40 to 70%, in terms of the ratio of (cross-sectional area of aluminum electric-wire's conductor part at crimped portion)/(cross-sectional area of aluminum electric-wire's conductor part before crimping).

Moreover, claim 13 of the present invention recites the terminal crimping structure onto aluminum electric-wire of claim 10, characterized in that the cross-sectional area of the aluminum electric-wire's conductor part to be crimped with the aluminum-electric-wire conducting crimp barrel is 1.5 $mm^2$ or more, and, after the terminal is crimped, the compressed ratio of the aluminum electric-wire's conductor part in the region of the wire barrel having the smaller height has an upper limit value of 70% in terms of the ratio of the (cross-sectional area of aluminum electric-wire's conductor part at crimped portion)/(cross-sectional area of aluminum electric-wire's conductor part before crimping), and a lower limit value where the terminal crimping strength becomes 100N.

Controlling the compressed ratio of the aluminum electric-wire's conductor part in the region of the wire barrel having the smaller height based on the above described upper limit value after the terminal is crimped, makes it possible to maintain a stable electric connection without causing a resistance increase of the aluminum electric-wire with terminal in an environmental test for exposing a test target to high temperatures and low temperatures.

Further, controlling such a compressed ratio based on the above described lower limit value avoids a considerable deterioration of crimping strength of the aluminum electric-wire. This prevents occurrence of mechanical damages such as electric-wire breakage at the crimped aluminum electric-wire portion.

Note that, in case where the cross-sectional area of the aluminum electric-wire's conductor part is 1.5 $mm^2$ or more, the crimping strength of the aluminum electric-wire is not considerably deteriorated even when the above compressed ratio is controlled based on the above described lower limit value. This prevents occurrence of mechanical damages such as electric-wire breakage at the crimped aluminum electric-wire portion.

Further, claim 14 of the present invention recites a terminal crimping structure onto aluminum electric-wire, for crimping a terminal comprising: an aluminum-electric-wire's coating part crimping insulation barrel; as well as an aluminum-electric-wire conducting crimp barrel and an aluminum-electric-wire retaining crimp barrel; onto an aluminum electric-wire; characterized in that the aluminum-electric-wire retaining crimp barrel is formed at a position neighboring to the insulation barrel, the aluminum-electric-wire conducting crimp barrel is formed at a side opposite to the insulation barrel with respect to the aluminum-electric-wire retaining crimp barrel, and the aluminum-electric-wire conducting crimp barrel is crimped onto the aluminum electric-wire at a height lower than that of the aluminum-electric-wire retaining crimp barrel when viewed in the terminal crimping direction in a state where both of the crimp barrels are crimped onto the aluminum electric-wire.

Since the aluminum-electric-wire conducting barrel is crimped onto the electric-wire at a position closer to the tip end of the electric-wire (i.e., more inwardly of the terminal) than the aluminum-electric-wire retaining barrel, no problems are caused in the retaining force of the terminal for the electric-wire by virtue of the function of the rearward retaining barrel even when the terminal crimping strength of the conducting barrel portion is weak. Further, since the electric-wire is firmly retained by the rearward retaining barrel, the conducting barrel is allowed to be crimped at a forward position at a higher compressed ratio (surface-area reducing ratio) so as to break the insulative oxide film of aluminum electric-wire and so as to be closely contacted therewith, thereby obtaining a sufficient electric characteristic between the terminal and aluminum electric-wire.

Further, claim 15 of the present invention recites the terminal crimping structure onto aluminum electric-wire of claim 14, characterized in that there is formed a slit between the aluminum-electric-wire conducting crimp barrel and the aluminum-electric-wire retaining crimp barrel.

Formation of such a slit enables the aluminum-electric-wire conducting crimp barrel and the aluminum-electric-wire retaining crimp barrel to be crimped independently of each other. Thus, the aluminum-electric-wire retaining crimp barrel retains the aluminum electric-wire at the same compressed ratio (surface-area reducing ratio) as the conventional copper electric-wire, and the aluminum-electric-wire conducting crimp barrel is crimped onto the aluminum electric-wire at a higher compressed ratio (surface-area reducing ratio) so as to break the insulative oxide film of the electric-wire and so as to be closely contacted therewith, thereby enabling the crimping while ensuring a due electric conducting property.

Moreover, claim 16 of the present invention recites a terminal crimping structure onto aluminum electric-wire, for crimping a terminal comprising: an aluminum-electric-wire's coating part crimping insulation barrel; and an electrical-conductor crimping barrel having different front and rear heights (lengths); onto an aluminum electric-wire; characterized in that the aluminum electric-wire's conductor crimping barrel is formed at a position neighboring to the insulation barrel; and the electrical-conductor crimping barrel has an oblique structure (having a higher front portion and a lower rear portion) having a height increased in a direction (forward direction of terminal) departing from the insulation barrel, before the terminal is crimped, so that the portion (rearward portion) having the smaller barrel height is crimped onto the aluminum electric-wire at a smaller biting depth and the portion (forward portion) having the larger barrel height is crimped onto the aluminum electric-wire at a larger biting depth, and so that the electrical-conductor crimping barrel is brought to have a contacting extent with wire-elements constituting the aluminum electric-wire and the wire-elements have a compressed ratio, in which both of the contacting extent and the compressed ratio are varied in the terminal-wise longitudinal direction relative to the aluminum electric-wire (i.e., more at the forward portion and less at the rearward portion).

In the crimping to the aluminum electric-wire, the rear portion (i.e., the portion having the lower barrel length) of the electrical-conductor crimping barrel has a smaller biting depth into the aluminum electric-wire and firmly retains the electric-wire, and the front portion (i.e., the portion having the higher barrel length) of the electrical-conductor crimping barrel has a larger biting depth into the core of the aluminum electric-wire so as to contact with most of wire-elements (strands) constituting the aluminum electric-wire, thereby enabling a stable conduction.

Further, claim 17 of the present invention recites a producing method of aluminum electric-wire with terminal, for crimping a terminal comprising: an aluminum-electric-wire's coating part crimping insulation barrel; as well as an aluminum-electric-wire conducting crimp barrel and an aluminum-electric-wire retaining crimp barrel; onto an aluminum electric-wire; characterized in that the method comprises the step of: crimping the aluminum-electric-wire conducting crimp barrel onto the aluminum electric-wire at a height lower than that of the aluminum-electric-wire retaining crimp barrel when viewed in the terminal crimping direction in a state where the aluminum-electric-wire conducting crimp barrel and the aluminum-electric-wire retaining crimp barrel are crimped onto the aluminum electric-wire, thereby producing the aluminum electric-wire crimped with the terminal.

Moreover, claim 18 of the present invention recites a producing method of aluminum electric-wire with terminal, for crimping a terminal comprising: an aluminum-electric-wire's coating part crimping insulation barrel; and an aluminum electric-wire's conductor crimping barrel having different front and rear barrel heights; onto an aluminum electric-wire; characterized in that the method comprises the step of: using the terminal, in which the aluminum electric-wire's conductor crimping barrel is formed at a position neighboring to the insulation barrel, and in which the electrical-conductor crimping barrel has an oblique structure having a height increased in a terminal direction departing from the insulation barrel, before the terminal is crimped; and crimping the terminal onto the aluminum electric-wire, such that the portion having the smaller barrel height is crimped onto the aluminum electric-wire at a smaller biting depth and the portion having the larger barrel height is crimped onto the aluminum electric-wire at a larger biting depth, and such that the electrical-conductor crimping barrel is brought to have a contacting extent with wire-elements constituting the aluminum electric-wire and the wire-elements have a compressed ratio, in which both of the contacting extent and the compressed ratio are varied in the terminal-wise longitudinal direction relative to the aluminum electric-wire; thereby producing the aluminum electric-wire crimped with the terminal.

By practicing the producing method of aluminum electric-wire with terminal recited in claim 17 or claim 18 of the present invention, there are ensured terminal crimping strengths (retaining forces between terminals and electric-wires) required for various aluminum electric-wire sizes, and the insulative oxide films of aluminum electric-wires are broken and the terminals are closely contacted with aluminum electric-wires, thereby enabling obtainment of aluminum electric-wires crimped with terminals ensuring electric conducting properties.

DETAILED DESCRIPTION OF THE PREFERRED EMBODIMENTS

There will be explained hereinafter a terminal crimping structure and a terminal crimping method onto aluminum electric-wire, and a producing method of an aluminum electric-wire with a terminal, according to a first embodiment and a second embodiment of the present invention, based on the drawings.

Figure 1A:
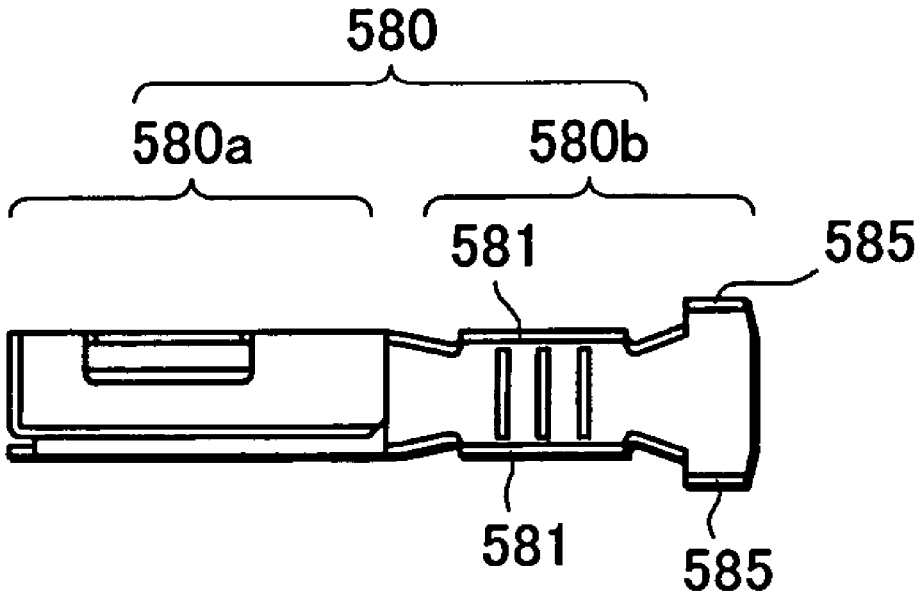
FIG. 1 includes a cross-sectional view (FIG. 1A) and a side view (FIG. 1B) showing a conventional copper-electric-wire crimping terminal.
Figure 1B:
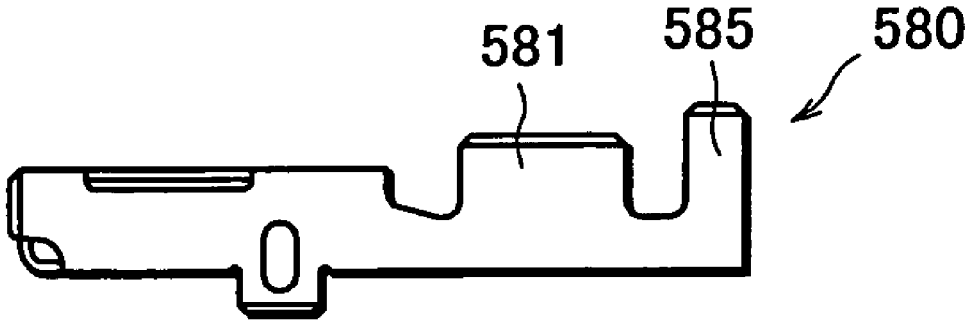
Figure 2A:
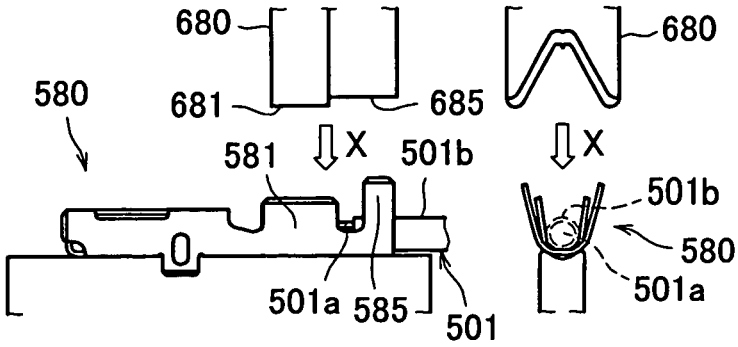
FIG. 2 is an explanatory process view showing a process for crimping the copper-electric-wire crimping terminal shown in FIG. 1 onto an aluminum electric-wire.
Figure 2B:
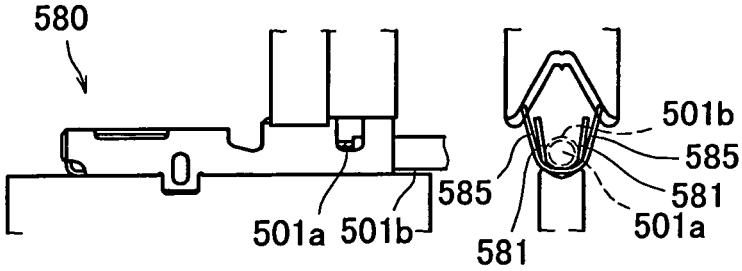
Figure 2C:
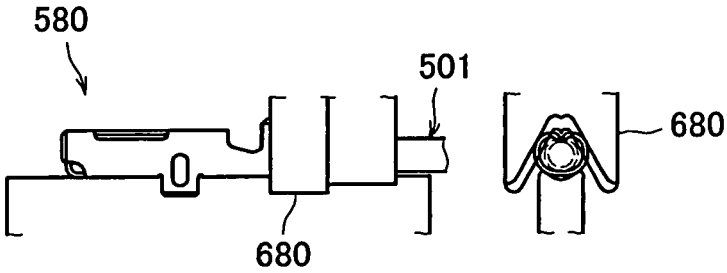
Figure 2D:
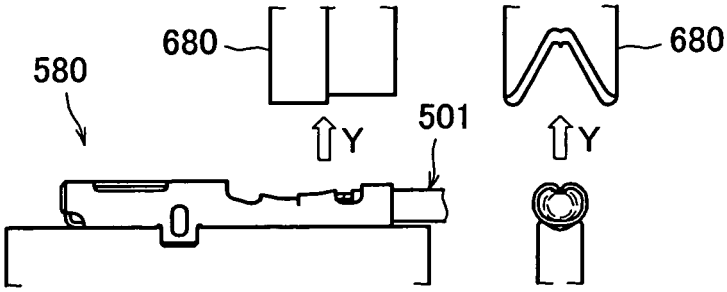
Figure 3A:
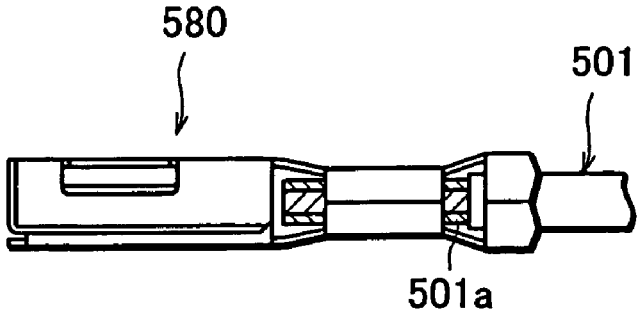
FIG. 3 includes a plan view (FIG. 3A) showing a state where the copper-electric-wire crimping terminal shown in FIG. 1 is crimped onto an aluminum electric-wire, a side view (FIG. 3B) showing a state crimped at a lower compressed ratio (surface-area reducing ratio) and a side view (FIG. 3C) showing a state crimped at a higher compressed ratio (surface-area reducing ratio)
Figure 3B:
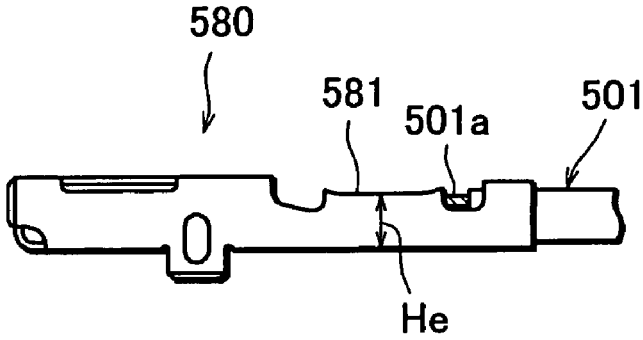
Figure 3C:
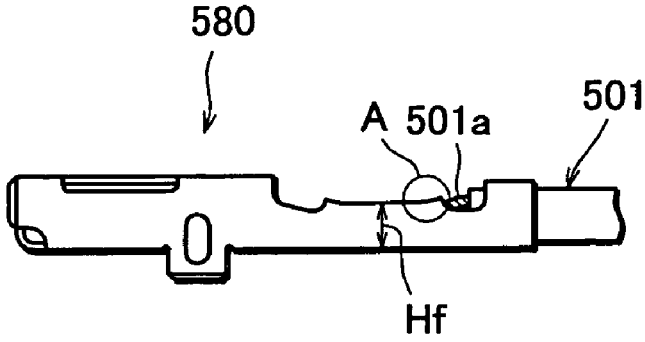
Figure 4A:
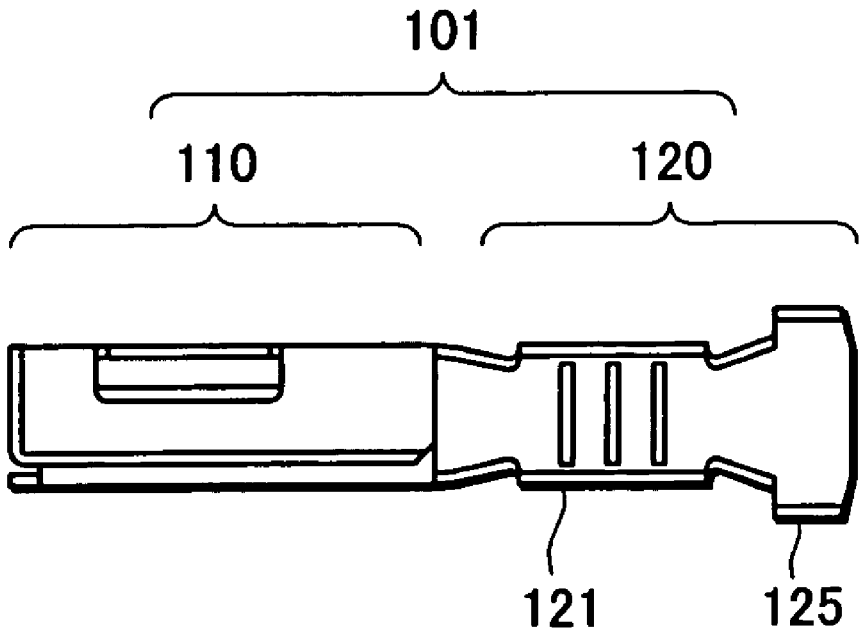
FIG. 4 includes a plan view (FIG. 4A) and a side view (FIG. 4B) showing a terminal to be used for a terminal crimping structure onto aluminum electric-wire, according to a first embodiment of the present invention.
Figure 4B:
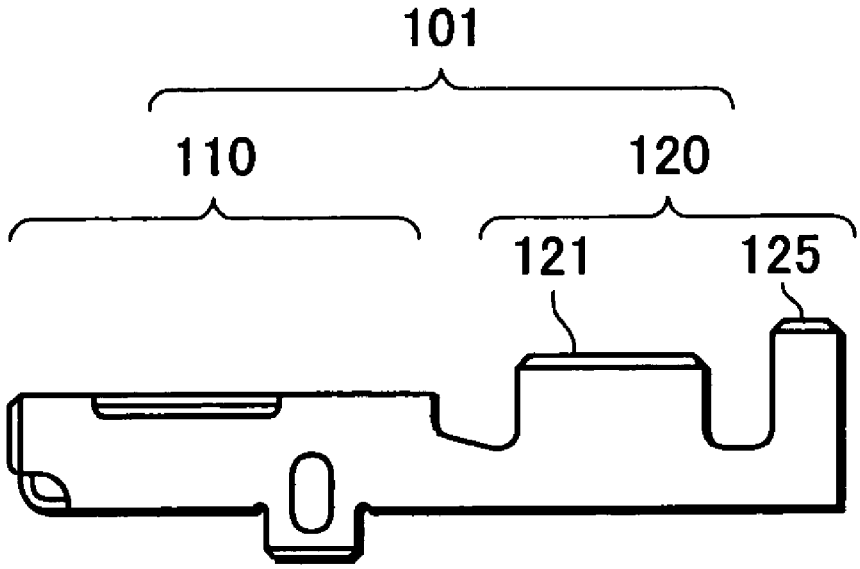

As shown in FIG. 4, reference numeral 101 designates a terminal according to a first embodiment of the present invention to be used for a terminal crimping structure onto an aluminum electric-wire, such that the terminal 101 is constituted of a terminal connecting portion 110 and an electric-wire connecting portion 120, and the electric-wire connecting portion 120 has a wire barrel 121 to be crimped onto an electrical conductor part of the aluminum electric-wire, and an insulation barrel 125 to be crimped onto a resin coating of the aluminum electric-wire. Further, the wire barrel 121 has a cross-section in a substantially "U" shape, thereby forming a terminal of a so-called opened barrel type.

Figure 5A:
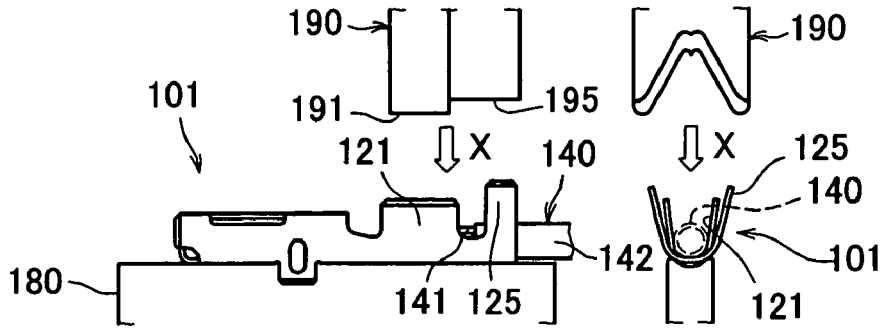
FIG. 5 is a process view showing a terminal crimping method onto aluminum electric-wire according to the first embodiment of the present invention, in a sequence of FIG. 5A through FIG. 5D.

Such a terminal 101 is crimped onto an aluminum electric-wire 140, by the following process. Firstly, as shown in FIG. 5A, the aluminum-electric-wire crimping terminal 101 is fixed to a base 180, and the aluminum electric-wire 140 is suitably positioned relative to the aluminum-electric-wire crimping terminal 101. Namely, the aluminum electric-wire 140 has a coating part 142 positioned in a region embraced by the insulation barrel 125, and an electrical conductor part 141 positioned in a region embraced by the wire barrel 121. In this state, there is brought a crimping jig 190 toward the terminal from the above (see an arrow X representing a terminal crimping direction in FIG. 5A). Note that the crimping jig 190 is formed with crimping portions corresponding to the wire barrel 121 and insulation barrel 125 to be crimped, respectively. Namely, the jig is formed with a terminal crimping portion 191 at a position corresponding to the wire barrel 121 of the terminal 101, and a terminal crimping portion 195 at a position corresponding to the insulation barrel 125 of the terminal 101. Further, this crimping jig 190 is lowered toward the terminal side by an actuator not shown (see FIG. 5B). This lowering operation causes the end portions of the barrels 121, 125 to be gradually curled along crimping grooves of the crimping portions of the crimping jig 190, respectively, and the barrel end portions are deformed (curled) in due course toward a central axis direction of the aluminum electric-wire 140 within the crimping jig 190 (see FIG. 5C).

Further lowering the crimping jig 190 urges the wire barrel tip ends into between strands of the electrical conductor part 141 of the aluminum electric-wire 140. Simultaneously therewith, the insulation barrel 125 is also crimped onto the coating part 142 of the aluminum electric-wire 140.

In this way, in crimping the terminal 101 onto the aluminum electric-wire's conductor part 141, the terminal 101 is crimped onto the aluminum electric-wire 140 such that the compressed ratio (surface-area reducing ratio) of the aluminum electric-wire's conductor part to be defined by a ratio of (cross-sectional area of aluminum electric-wire's conductor part at crimped portion)/(cross-sectional area of aluminum electric-wire's conductor part before crimping) falls within a range of 50 to 70%, though the concrete compressed ratio slightly varies depending on an electric-wire size. It should be particularly noted that this range of compressed ratio is perfectly out of the presently practiced range, insofar as crimping a terminal onto a typical copper electric-wire. When the terminal crimping operation is finished, the crimping jig is raised to thereby complete the terminal crimping process (see FIG. 5D).

Note that the reason why the compressed ratio of the terminal 101 onto the aluminum electric-wire 140 has been defined in the above manner is based on extensive experimental data, and this will be explained in the following description and in the paragraphs of the Examples to be described later.

Figure 6A:
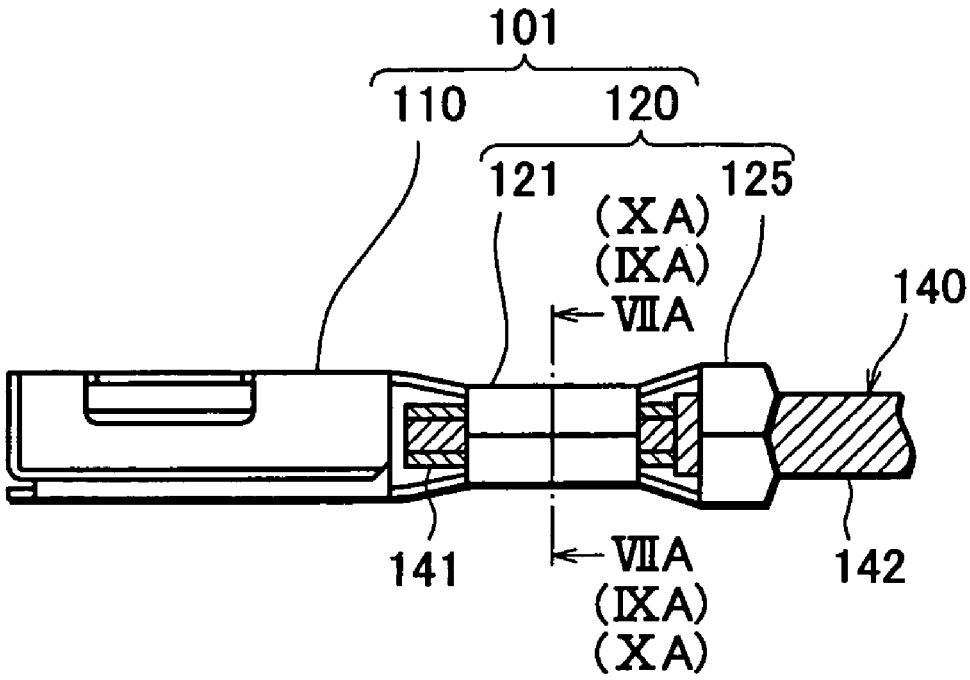
FIG. 6 includes a plan view (FIG. 6A) and a side view (FIG. 6B) showing the terminal crimping structure onto aluminum electric-wire, according to the first embodiment of the present invention.
Figure 6B:
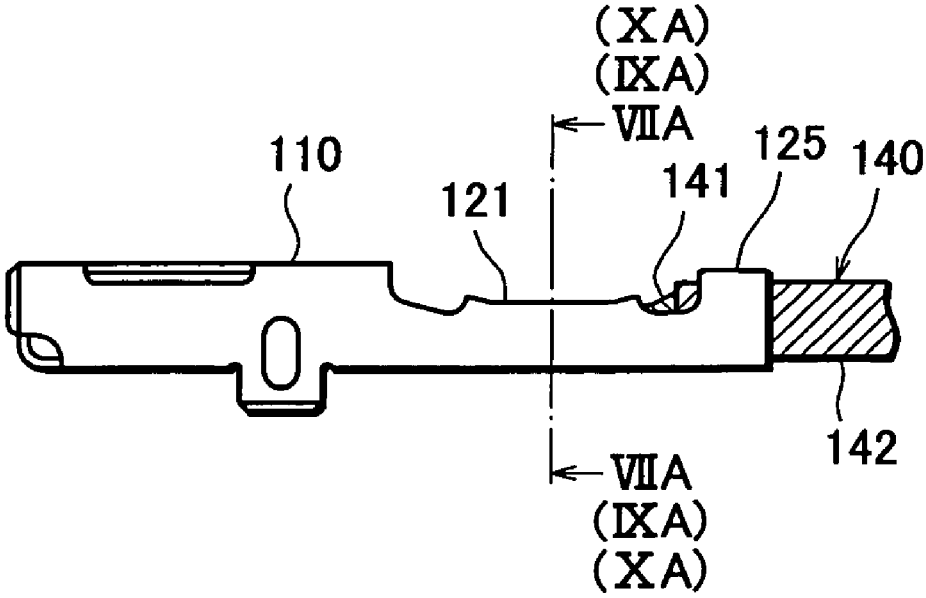

FIG. 6 includes a plan view (FIG. 6A) and a side view (FIG. 6B) showing the aluminum electric-wire with terminal according to this embodiment in a state where the terminal has been crimped onto the aluminum electric-wire in the above manner. Further, FIG. 7 shows a crimped cross-section comprising a VIIA-VIIA cross-sectional view in FIG. 6.

Figures 7A, 7B:
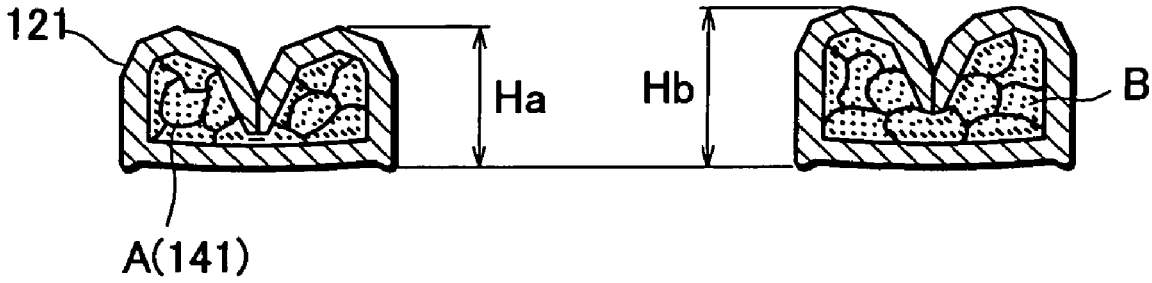
FIG. 7 includes a VIIA-VIIA cross-sectional view (FIG. 7A) of FIG. 6A, and a cross-sectional view (FIG. 7B) of a terminal-crimped portion in a terminal crimping structure outside the scope of the present invention.

Moreover, FIG. 7B is a cross-sectional view showing a terminal crimping structure outside the scope of the present invention.

As represented as crimp height values Ha, Hb in FIG. 7, the crimp height of a terminal is called a crimp height value, and the compressed ratio (surface-area reducing ratio) of the electric-wire by the terminal is typically controlled based on such a crimp height value.

In case of a smaller crimp height value such as in a cross-section example A shown in FIG. 7A, the electrical conductor has a smaller cross-sectional area and has been crimped onto a highly compressed state. Contrary, in case of a larger crimp height value such as in a cross-section example B shown in FIG. 7B, the electrical conductor has a larger cross-sectional area and has been crimped onto a lowly compressed state.

For example, when the compressed ratio of the cross-section example A having the small crimp height value is 70%, this corresponds to a terminal crimping structure onto an aluminum electric-wire according to this embodiment. Meanwhile, the cross-section example B having the crimp height value (electrical conductor's cross-sectional area) larger than the cross-section example A is to have a compressed ratio which is numerically larger than 70%, and this corresponds to a terminal crimping structure onto a copper electric-wire concerning the present invention.

Namely, the compressed ratio means a surface-area reducing ratio assuming that the cross-sectional area of the electric-wire's conductor before crimped with a terminal is 100%, and smaller crimp height values or electrical conductor's cross-sectional areas after crimping result in higher compression. Further, higher compression results in smaller numerical values of the compressed ratio. Namely, higher compressed ratios mean those compressed ratios which have smaller concrete numerical values, and lower compressed ratios mean those compressed ratios which have larger concrete numerical values.

Conventional terminal crimping structures onto copper electric-wires have been controlled based on crimp height values which actually correspond to targeted compressed ratios, in a manner that the resultant compressed ratio falls within a range of about 75 to 95%, though it slightly varies such as depending on kinds of terminals and electric-wire diameters.

Meanwhile, when aluminum electric-wires are crimped based on the presently controlled values, resistance increase is caused in an environmental test which requires high temperatures and low temperatures, thereby failing to maintain a stable electric connection.

Nonetheless, the present inventor has conducted extensive experiments and succeeded in specifying an optimum controlling value to be within a range of 50 to 70% which is limited to aluminum electric-wires, thereby providing a stable electric connection which clears the environmental test. This point will be explained in the paragraphs of the Examples to be described later.

Note that the reason why compressed ratios (surface-area reducing ratios) of 71% or more and less than 50% are inappropriate is as follows.

As also apparent from the paragraphs of the Examples to be described later, the reason why compressed ratios of 71% or more are inappropriate is that the resistance of the crimped portion is then increased by 1.0 mΩ or more between before and after the environmental test (thermal cycles), thereby failing to maintain a stable electric connection state. Further, the reason why compressed ratios less than 50% are inappropriate is that the crimping strength is then considerably deteriorated when the electrical conductor's cross-sectional area after terminal crimping is highly compressed to ½ or less of the electrical conductor's cross-sectional area before terminal crimping.

Next, there will be explained an experimental result as a basis for defining the above compressed ratio, based on an Example 1.

EXAMPLE 1

Terminals were crimped onto aluminum electric-wires having electrical conductor parts of various cross-sectional areas at various compressed ratios, and there was conducted such a thermal shock test, i.e., a test for continuously and alternately repeating a low temperature environment (−40° C.) and a high temperature environment (120° C.), for these aluminum electric-wires with crimped terminals. Further, the external appearances of the terminal-crimped portions before and after the test were compared with each other, and there were measured the resistance change and the like of the electrically connected portions before and after the test.

This thermal shock test is suitable for evaluating a connecting ability of a terminal-crimped portion. Further, the thermal shock test was performed by 1,000 cycles.

Figure 8:
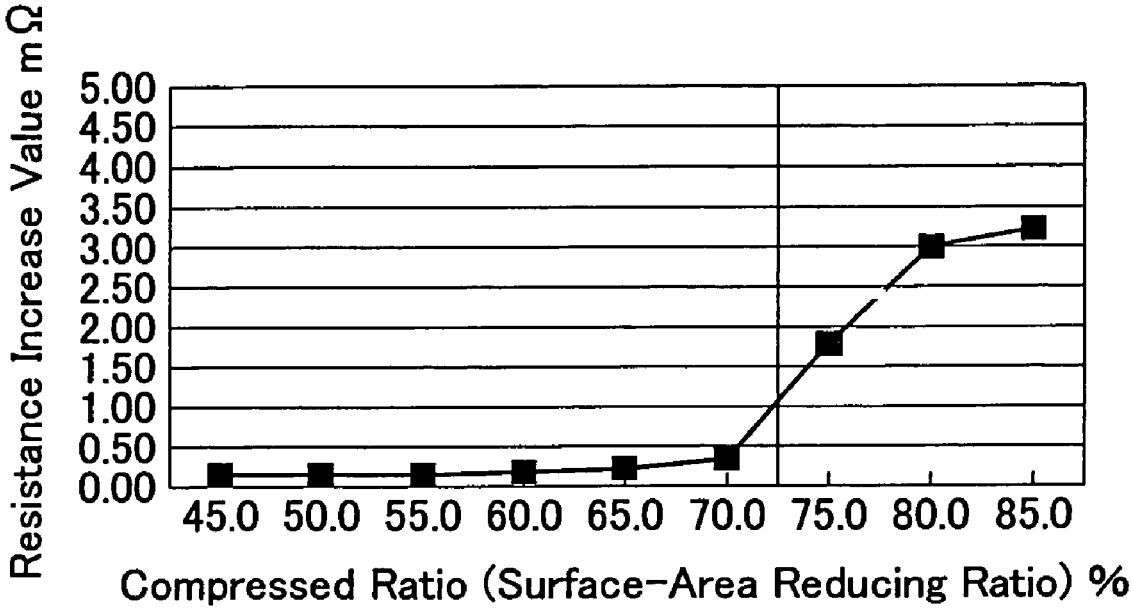
FIG. 8 is a graph showing test data of Examples concerning the first embodiment and first modification and second modification thereof.

Listed in Table 1 are representative resistance increase values between before and after the environmental test (thermal shock test). Further, FIG. 8 shows a graph plotting these values.

TABLE 1

| | Compressed ratio (%) | | | | | | | | |
|---|---|---|---|---|---|---|---|---|---|
| | 45.0 | 50.0 | 55.0 | 60.0 | 65.0 | 70.0 | 75.0 | 80.0 | 85.0 |
| Resistance increase value (mΩ) | 0.13 | 0.12 | 0.14 | 0.18 | 0.22 | 0.36 | 1.80 | 3.00 | 3.20 |

In view of the result of Table 1, the present inventor has selected a compressed ratio of 70% as an upper limit, by aiming at a stable target value for the resistance increase value within a range of 1.0 mΩ.

Note that FIG. 8 shows a representative graph, and it has been understood that the range of 50% to 70% of the compressed ratio is a stability region, though such a range slightly varies depending on various types of aluminum wires and diameters thereof. Further, although the resistance increase value similarly became smaller as the degree of the compressed ratio became smaller, the lower limit value of the compressed ratio was set at 50%. This is because, when the compressed ratio is less than 50%, i.e., when the electrical conductor's cross-sectional area before crimping the terminal is highly compressed to ½ or less after crimping the terminal, the crimping strength is considerably deteriorated so that the mechanical connecting strength at the terminal-crimped portion is deteriorated.

It was seen from the above evaluating test that, when terminals are crimped onto aluminum electric-wires at compressed ratios within a range of 50 to 70%, stably conductive connections can be maintained between the aluminum electric-wires and terminals without deteriorating the strength at the terminal-crimped portions.

There will be explained hereinafter a terminal crimping structure and a terminal crimping method onto aluminum electric-wire, and a producing method of an aluminum electric-wire with a terminal, according to a first modification of the above first embodiment, based on the drawings.

Note that, in this first modification, the compressed ratio of the aluminum electric-wire's conductor part by a wire barrel in terms of the ratio of (cross-sectional area of aluminum electric-wire's conductor part at crimped portion)/(cross-sectional area of aluminum electric-wire's conductor part before crimping), is set to be within a range of 40 to 70% when the cross-sectional area of the aluminum electric-wire's conductor part to be crimped with a terminal is 1.5 $mm^2$ or more.

The terminal 101 to be used in the terminal crimping structure onto aluminum electric-wire according to the first modification has the same constitution as the above described embodiment, i.e., the terminal is constituted of a terminal connecting portion 110 and an electric-wire connecting portion 120, and the electric-wire connecting portion 120 has a wire barrel 121 to be crimped onto an electrical conductor part, and an insulation barrel 125 to be crimped onto a resin coating of the aluminum electric-wire. Further, the wire barrel 121 has a cross-section in a substantially "U" shape, thereby forming a terminal of a so-called opened barrel type.

Such a terminal 101 is crimped onto an aluminum electric-wire 140 including an electrical conductor part having a cross-sectional area of 1.5 $mm^2$ or more by the following process, similarly to the above described second embodiment. Firstly, as shown in FIG. 5A, the aluminum-electric-wire crimping terminal 101 is fixed to a base 180, and the aluminum electric-wire 140 having the electrical conductor part having the cross-sectional area of 1.5 $mm^2$ or more is suitably positioned relative to the aluminum-electric-wire crimping terminal 101. Namely, the aluminum electric-wire 140 has a coating part 142 positioned in a region embraced by the insulation barrel 125, and an electrical conductor part 141 positioned in a region embraced by the wire barrel 121. In this state, there is brought a crimping jig 190 including crimping grooves having specific shapes when viewed in the terminal-wise longitudinal direction, toward the terminal from the above (see an arrow X representing a terminal crimping direction in FIG. 5A). Note that the crimping jig 190 is formed with crimping portions corresponding to the wire barrel 121 and insulation barrel 125 to be crimped, respectively. Namely, the jig is formed with a terminal crimping portion 191 at a position corresponding to the wire barrel 121 of the terminal 101, and a terminal crimping portion 195 at a position corresponding to the insulation barrel 125 of the terminal 101.

Figure 5B:
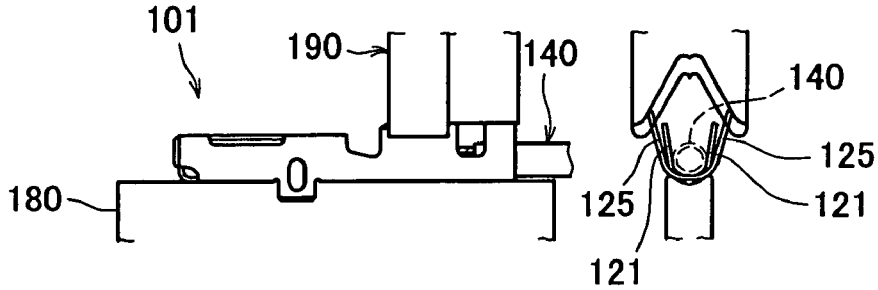

Further, this crimping jig 190 is lowered toward the terminal side by an actuator not shown (see FIG. 5B). This lowering operation causes the end portions of the barrels 121, 125 to be gradually curled along crimping grooves of the crimping portions of the crimping jig 190, respectively, and the barrel end portions are deformed (curled) in due course toward a central axis direction of the aluminum electric-wire 140 within the crimping jig 190 (see FIG. 5C).

Moreover, lowering the crimping jig 190 urges the wire barrel tip ends into between strands of the electrical conductor part 141 of the aluminum electric-wire 140. Simultaneously therewith, the insulation barrel 125 is also crimped onto the coating part 142 of the aluminum electric-wire 140.

In this way, the terminal 101 is crimped onto the electrical conductor part 141 having a cross-sectional area of 1.5 $mm^2$ or more. In crimping, the terminal 101 is crimped onto the aluminum electric-wire 140 such that the compressed ratio (surface-area reducing ratio) of the aluminum electric-wire's conductor part to be defined by a ratio of (cross-sectional area of aluminum electric-wire's conductor part at crimped portion)/(cross-sectional area of aluminum electric-wire's conductor part before crimping) falls within a range of 40 to 70%, though the concrete compressed ratio slightly varies depending on an electric-wire size. It should be particularly noted that this range of compressed ratio is perfectly out of the presently practiced range, insofar as crimping a terminal onto a typical copper electric-wire. When the terminal crimping operation is finished, the crimping jig is raised to thereby complete the terminal crimping process (see FIG. 5D).

Note that the reason why the compressed ratio of the terminal 101 onto the aluminum electric-wire 140 has been defined in the above manner is based on extensive experimental data, and this is based on the Example 1 and will be explained in an Example 2 to be described later.

The aluminum electric-wire with terminal according to this first modification provided by crimping the terminal onto the aluminum electric-wire in the above manner, is the same as that shown in a plan view (FIG. 6A) and a side view (FIG. 6B) of FIG. 6. Further, FIG. 9A shows a crimped cross-section (IXA-IXA cross-sectional view in FIG. 6) of the aluminum electric-wire crimped according to this first modification.

Figures 9A, 9B:
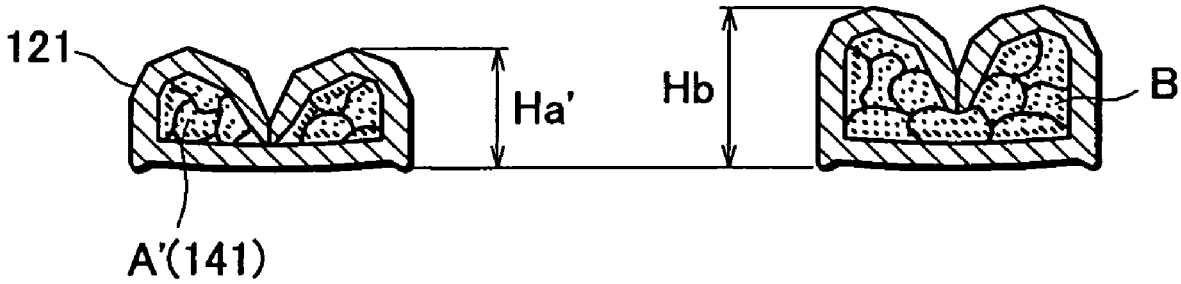
FIG. 9 includes an IXA-IXA cross-sectional view (FIG. 9A) of FIG. 6 concerning the first modification of the first embodiment, and a cross-sectional view (FIG. 9B) of a crimped portion in a terminal crimping structure of a copper electric-wire outside the scope of the present invention.

Moreover, FIG. 9B is a cross-sectional view showing a typical terminal crimping structure outside the scope of the present invention.

For example, when the compressed ratio of the cross-section example A' having a small crimp height value is 45%, this corresponds to a terminal crimping structure onto aluminum electric-wire according to this first modification. Meanwhile, the cross-section example B having the crimp height value (electrical conductor's cross-sectional area) larger than the cross-section example A' is to have a compressed ratio which is numerically larger than 70%, and this corresponds to a terminal crimping structure outside the scope of the present invention.

Note that the reason why compressed ratios exceeding 70% and compressed ratios less than 40% are inappropriate, is as follows.

As also apparent from the contents of the above described Example 1, the reason why compressed ratios exceeding 70% are inappropriate is that the resistance of the crimped portion is then increased by 1.0 mΩ or more between before and after the environmental test (thermal cycles), thereby failing to maintain a stable electric connection state.

Further, the reason why the lower limit value of the compressed ratio is set at 40% and compressed ratios less than it are inappropriate, is that, although the crimping strength is considerably lowered when the electrical conductor's cross-sectional area is highly compressed to ½, the electric-wire of the size having an electrical conductor's cross-sectional area of 1.5 $mm^2$ or more has an inherently higher tensile strength so that the targeted strength is satisfied even when the lower limit value of the compressed ratio is lowered to 40%, as apparent from the Example 2 to be described later.

Next, there will be explained an experimental result as a basis that the above described lower limit value of the compressed ratio is lowered to 40%, based on an Example 2.

EXAMPLE 2

This Example 2 is to prove why the lower limit value of the compressed ratio is defined to be 40% in crimping a terminal onto an aluminum electric-wire including an electrical conductor part having a cross-sectional area of 1.5 $mm^2$ or more.

Concretely, the smaller the concrete numerical value of the compressed ratio, the smaller the above described resistance increase value in the similar manner. Meanwhile, in case of an aluminum electric-wire including an electrical conductor part having a cross-sectional area less than 1.5 $mm^2$, the lower limit value of compressed ratio is preferably considered to be 50%, because the crimping strength is considerably deteriorated and the mechanical connecting strength at the terminal-crimped portion is deteriorated when the compressed ratio is less than 50%, i.e., when the electrical conductor's cross-sectional area before crimping the terminal is highly compressed to ½ or less after crimping the terminal. Nonetheless, it has been found from the following test result, that the lower limit value of compressed ratio can be lowered to 40% when the cross-sectional area of an aluminum electric-wire's conductor part is 1.5 $mm^2$ or more. The reason thereof is that, although the crimping strength is considerably lowered when the electrical conductor's cross-sectional area is highly compressed to ½, the aluminum electric-wire of the size including an electrical conductor part having a cross-sectional area of 1.5 $mm^2$ or more has an inherently higher tensile strength so that the targeted strength is satisfied even when crimped down to 40%.

The test result will be described below. Note that even electric-wires of the same size ($mm^2$) have different properties (such as strength), such as depending on the constitution (manner of twisting, the number of wire-elements and the like), material (various aluminum alloys), and refinement (solution treatment, aging treatment, annealing). Thus, in this Example, the present inventor has adopted an aluminum electric-wire, which is the smallest size of 1.5 $mm^2$ and which includes typically used constitution, material, refinement and the like under the condition that the cross-sectional area of the aluminum electric-wire's conductor part is 1.5 $mm^2$ or more, thereby investigating a relationship between the compressed ratio and the crimping strength in this aluminum electric-wire and the terminal. The result thereof is shown in Table 2 and FIG. 11.

TABLE 2

| | Compressed ratio (%) | | | | | | | | | |
|---|---|---|---|---|---|---|---|---|---|---|
| | 25.0 | 30.0 | 35.0 | 40.0 | 45.0 | 50.0 | 55.0 | 60.0 | 65.0 | 70.0 |
| Terminal crimping strength (N) | 78.9 | 87.5 | 94.2 | 118.3 | 139.0 | 165.0 | 171.2 | 177.0 | 197.1 | 214.8 |

Note here that the strength required for preventing an electric-wire and a terminal from being broken and/or disconnected such as due to assembling and/or arranging operation of the electric-wire, is uniquely defined by electric-wire manufacturers and by users utilizing the electric-wire. However, the present inventor has defined the strength required for preventing an electric-wire and a terminal from being broken and/or disconnected such as due to assembling and/or arranging operation of the electric-wire, to be 100N in this Example, based on the previous experience of the present inventor.

As apparent from the above Table and the drawing (graph), it is possible to obtain strengths of 100N or higher by compressed ratios of 40% or more. Further, the lower limit value of the compressed ratio has been set at 40%, because that compressed ratio is 40% which satisfies a strength of 100N for the smallest size of 1.5 $mm^2$ under the condition that the cross-sectional area of the aluminum electric-wire's conductor part is 1.5 $mm^2$ or more.

Based on the above test result, it has been found that there can be maintained a stable conductive connection between an aluminum electric-wire and a terminal without deteriorating a strength at the terminal-crimped portion when the terminal is crimped onto the aluminum electric-wire at compressed ratios within a range of 40% to 70%.

There will be now explained hereinafter a terminal crimping structure and a terminal crimping method onto aluminum electric-wire, and a producing method of an aluminum electric-wire with a terminal, according to a second modification of the above first embodiment. Note that, in this second modification, although the cross-sectional area of the aluminum electric-wire's conductor part to be crimped is 1.5 $mm^2$ or more similarly to the first modification which has the lower limit value of 40% for the compressed ratio of the aluminum electric-wire's conductor part, this second modification is to have a lower limit value of the compressed ratio of the aluminum electric-wire's conductor part such that the terminal crimping strength becomes 100N then.

Note that, like reference numerals and drawings as used for the first embodiment and the first modification thereof are used here and the detailed explanation shall be omitted, since the shape of the terminal to be crimped and a concrete method for crimping such a terminal onto an aluminum electric-wire in this second modification are the same as those for the first embodiment and the first modification thereof.

The terminal 101 to be used in the terminal crimping structure onto aluminum electric-wire according to the second modification is also an opened barrel type, and is constituted of the terminal connecting portion 110 and electric-wire connecting portion 120 shown in FIG. 4. Further, the electric-wire connecting portion 120 has a wire barrel 121 and an insulation barrel 125.

Figure 5C:
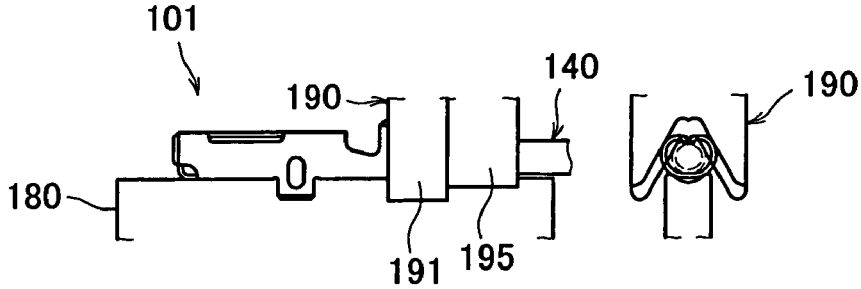

Such a terminal 101 is crimped onto an aluminum electric-wire 140 including an electrical conductor part having a cross-sectional area of 1.5 $mm^2$ or more, by the above described process shown in FIG. 5A through FIG. 5C.

Figure 5D:
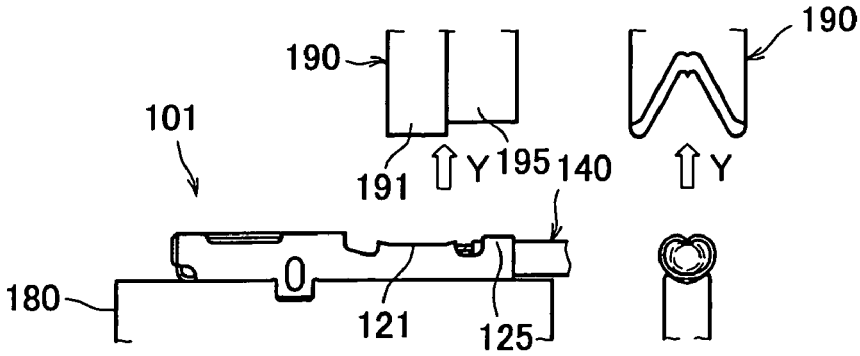

In crimping, the terminal is crimped onto an aluminum electric-wire including an electrical conductor part having a cross-sectional area of 1.5 $mm^2$ or more, such as an aluminum electric-wire including an electrical conductor part having a cross-sectional area of 2.5 $mm^2$. In this case, the terminal 101 is crimped onto the aluminum electric-wire 140, while setting the upper limit value of 70% for the compressed ratio (surface-area reducing ratio) of the aluminum electric-wire's conductor part to be defined by (cross-sectional area of aluminum electric-wire's conductor part at crimped portion)/(cross-sectional area of aluminum electric-wire's conductor part before crimping), and keeping the lower limit value of the compressed ratio within a range where the terminal crimping strength becomes 100N. Note that also this range of the compressed ratio is out of the presently practiced range, insofar as crimping a terminal onto a typical copper electric-wire. When this terminal crimping operation is finished, the crimping jig is raised to thereby complete the terminal crimping process as shown in FIG. 5D.

Note that the reason why the compressed ratio of the terminal 101 onto the aluminum electric-wire 140 has been defined in the above manner is based on extensive experimental data, and this is based on the Example 1 and will be explained in an Example 3 to be described later.

FIG. 6A is a plan view and a FIG. 6B is a side view, showing the aluminum electric-wire with terminal according to this modification in a state where the terminal is crimped onto the aluminum electric-wire in the above manner. Further, FIG. 10A (XA-XA cross-sectional view in FIG. 6) shows a crimped cross-section of the aluminum electric-wire crimped with the terminal according to this modification.

Figures 10A, 10B:
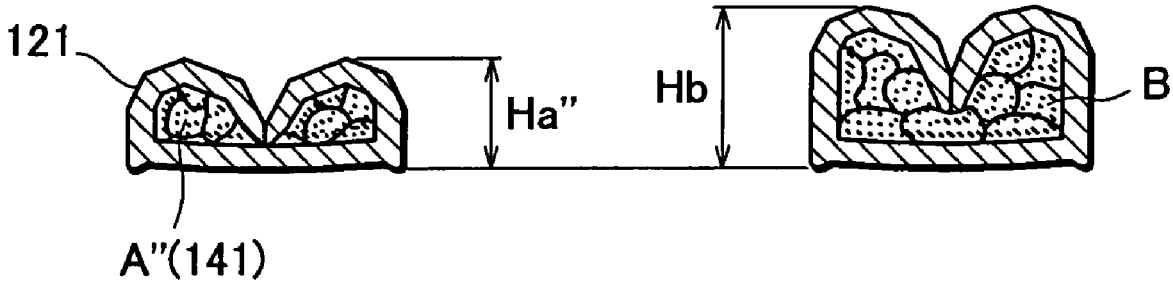
FIG. 10 includes an XA-XA cross-sectional view (FIG. 10A) of FIG. 6 concerning the first modification of the first embodiment, and a cross-sectional view (FIG. 10B) of a crimped portion in a terminal crimping structure of a copper electric-wire outside the scope of the present invention.

Further, FIG. 10B is a cross-sectional view showing a typical terminal crimping structure outside the scope of the present invention.

Note that, in the second modification, as understood by exemplarily comparing a crimp height value Ha" in FIG. 10A with a crimp height value Hb in FIG. 10B, the aluminum electric-wire including an electrical conductor part having a cross-sectional area of 2.5 $mm^2$ is considerably compressed at a compressed ratio of about 30%, so that the terminal is crimped onto the aluminum electric-wire's conductor part in a highly compressed state such that the cross-sectional area of the electrical conductor part after crimped with the terminal is smaller than the crimp height value Ha' in the above described first modification (cf. the cross-section A' in FIG. 9A and a cross-section A" in FIG. 10A).

The reason why compressed ratios exceeding 70% are inappropriate in an aluminum electric-wire including an electrical conductor part having a cross-sectional area of 1.5 $mm^2$ or more, is the same as the first embodiment and the first modification, i.e., the reason is that the resistance of the crimped portion is then increased by 1.0 mΩ or more between before and after the environmental test (thermal cycles), thereby failing to maintain a stable electric connection state.

Moreover, similarly to the above case where the lower limit value of the compressed ratio is selected to obtain the terminal crimping strength of 100N or more for the aluminum electric-wire including the electrical conductor part having the cross-sectional area of 1.5 $mm^2$ or more, the reason why the lower limit value of the compressed ratio is defined based on the terminal crimping strength, is as follows. Namely, although the crimping strength is considerably deteriorated when the electrical conductor's cross-sectional area is highly compressed to ½, the tensile strength of 100N can be satisfied even when the compressed ratio becomes less than 50% (½) since larger electric-wire sizes (cross-sectional areas of electric-wires' conductor parts) lead to higher tensile strengths though lower limit values (threshold values) of the compressed ratios of electric-wires of 1.5 $mm^2$ or more will vary depending on the electric-wire sizes.

Next, there will be explained an experimental result as a basis of the above defined lower limit value of the compressed ratio, based on an Example 3.

EXAMPLE 3

In the Example 3, the present inventor has adopted an aluminum electric-wire, which is a slightly larger size of 2.5 $mm^2$ and which includes typically used constitution, material, refinement and the like under the condition that the cross-sectional area of the aluminum electric-wire's conductor part is 1.5 $mm^2$ or more, thereby investigating a relationship between the compressed ratio and the crimping strength in this aluminum electric-wire and the terminal. The result thereof is shown in the following Table 3 and FIG. 12.

TABLE 3

| | Compressed ratio (%) | | | | | | | | | |
|---|---|---|---|---|---|---|---|---|---|---|
| | 25.0 | 30.0 | 35.0 | 40.0 | 45.0 | 50.0 | 55.0 | 60.0 | 65.0 | 70.0 |
| Terminal crimping strength (N) | 120.0 | 146.3 | 169.6 | 186.4 | 195.8 | 204.1 | 218.9 | 235.8 | 247.0 | 274.1 |

As understood from this test result, although the crimping strength is considerably deteriorated when the electrical conductor's cross-sectional area is highly compressed to ½, the crimping strength of 100N can be satisfied even when the compressed ratio becomes less than 50% (½) since larger sizes ($mm^2$) lead to higher tensile strengths though lower limit values (threshold values) of the compressed ratios of electric-wires of 1.5 $mm^2$ or more will vary depending on the electric-wire sizes.

Figure 11:
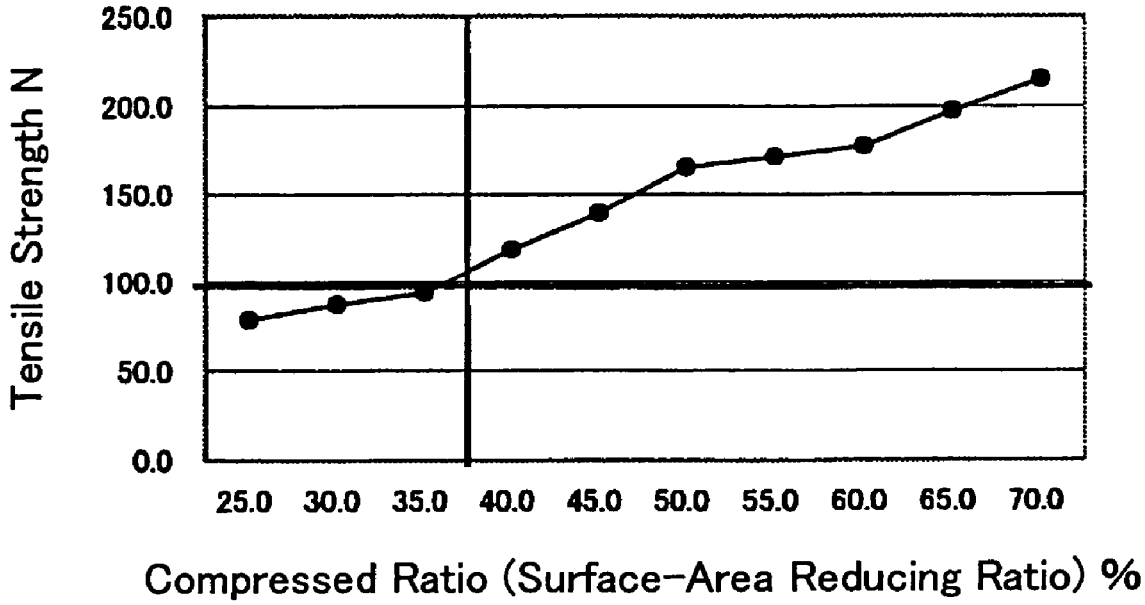
FIG. 11 is a graph showing test data of Example 2 concerning the first modification of the first embodiment.
Figure 12:
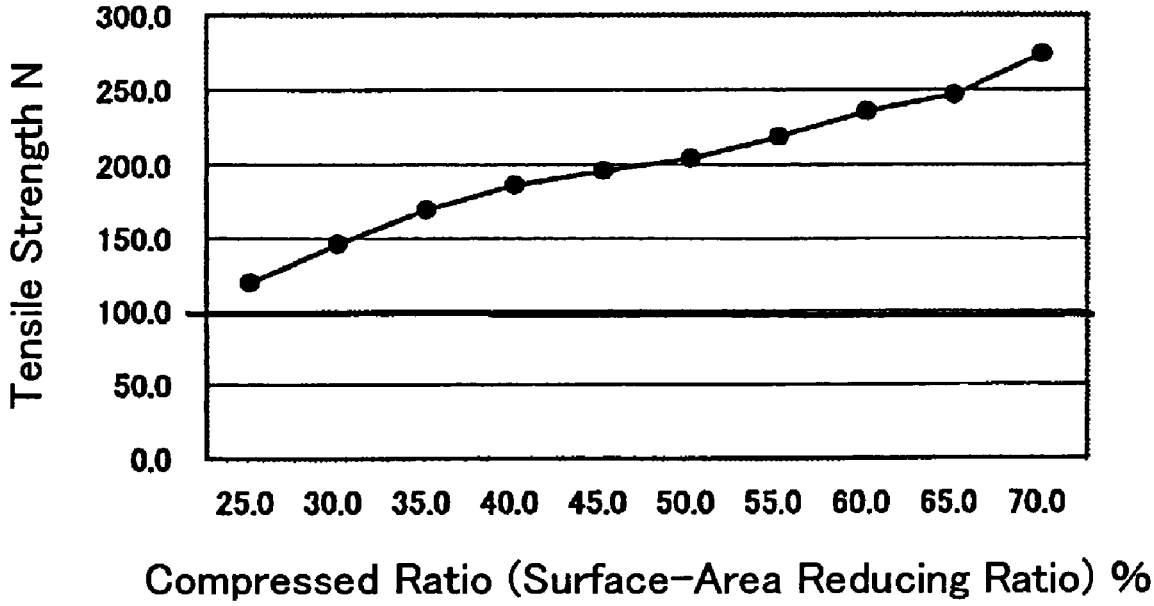
FIG. 12 is a graph showing test data of Example 3 concerning the second modification of the first embodiment.

This is also apparent from the fact that, although the threshold value of the compressed ratio is 40% for the crimping strength of 100N in the Example 2 shown in FIG. 11 where the aluminum electric-wire has the electrical conductor's cross-sectional area of 1.5 $mm^2$, the crimping strength of 100N can be satisfied by the compressed ratio down to 25% in the Example 3 shown in FIG. 12 where the aluminum electric-wire has the electrical conductor's cross-sectional area of 2.5 $mm^2$.

Based on the above and unlike the way in the first modification to define the lower limit value of the compressed ratio, the lower limit value of the compressed ratio of the aluminum electric-wire having the electrical conductor's cross-sectional area of 1.5 $mm^2$ or more is selected in this second modification such that the lower limit value corresponds to the crimping strength of 100N by the terminal.

Note that, although the inter-terminal connecting portion shown in the above embodiment is of a female shape (tongue-flap spring structure) in a conventional terminal, it is also possible to use a male shape, and various old and new terminal structures are usable as the inter-terminal connecting portion.

Further, although sufficient electric conducting properties can be obtained by crimping the terminals onto aluminum electric-wires at the above described compressed ratios, it becomes possible to attain a higher reliability by additionally and exemplarily coating anti-rust grease to the terminal connecting portion or terminal-crimped portion so as to prevent oxidation due to air or corrosion due to moisture at the terminal connecting portion.

There will be now explained in detail hereinafter a terminal crimping structure and a terminal crimping method onto aluminum electric-wire, and a producing method of an aluminum electric-wire with a terminal according to a second embodiment of the present invention, based on the drawings.

Figure 13A:
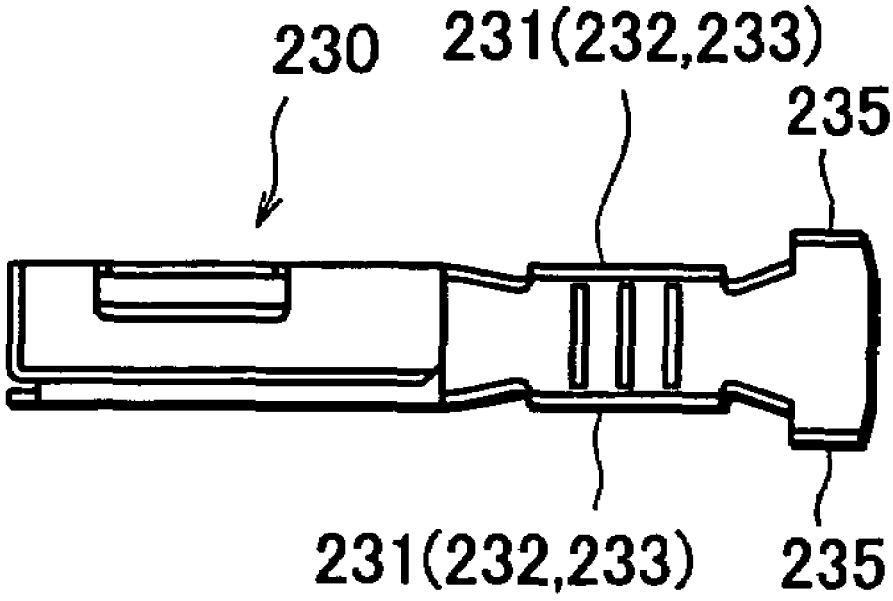
FIG. 13 includes a plan view (FIG. 13A) and a side view (FIG. 13B) showing an aluminum-electric-wire crimping terminal concerning a second embodiment of the present invention.
Figure 13B:
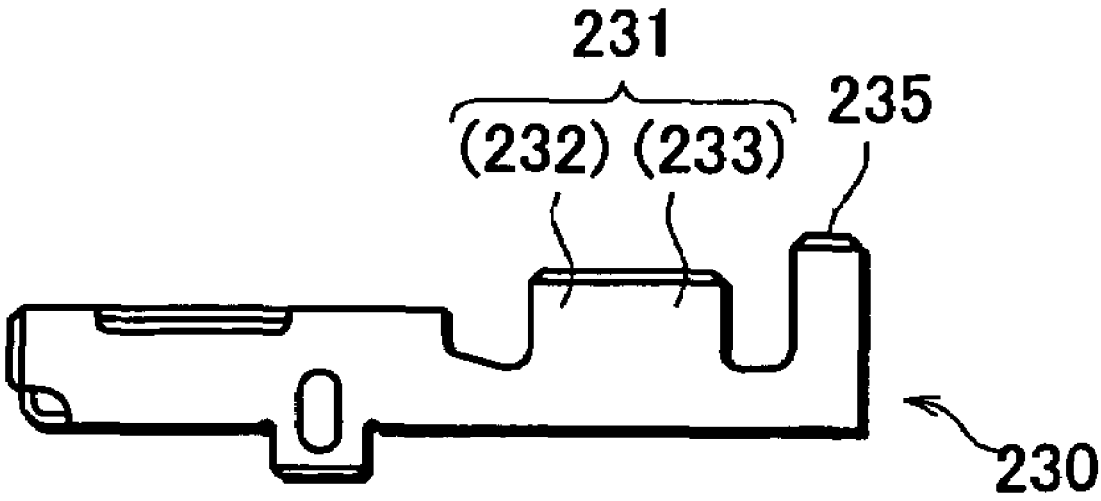

Here, FIG. 13 shows an aluminum-electric-wire crimping terminal 230 to be used in the second embodiment. The aluminum-electric-wire crimping terminal 230 is formed with an electroconductive barrel 231 comprising a conducting barrel 232 and a retaining barrel 233 integrated with each other. Namely, no slits are formed between the conducting barrel 232 and retaining barrel 233.

By directly adopting the crimping terminal having been widely used in the past and by adopting a specifically stepped crimping jig 310 (see FIG. 14) to thereby crimp the aluminum-electric-wire crimping terminal 230 onto an aluminum electric-wire 201, the conducting barrel 232 and retaining barrel 233 can be crimped in a stepped state corresponding to the step difference of the crimping jig 310. In this way, when the aluminum-electric-wire crimping terminal 230 in the state where the conducting barrel 232 and retaining barrel 233 are integrally formed with each other as the electroconductive barrel 231, is crimped by using the crimping jig 320 in the specific shape, the region having a smaller height corresponds to the aluminum-electric-wire conducting crimp barrel (conducting barrel 232) and the region having a larger height corresponds to the aluminum-electric-wire retaining crimp barrel (retaining barrel 233) when viewed in the terminal crimping direction in the state where the terminal 230 is crimped.

Figure 14A:
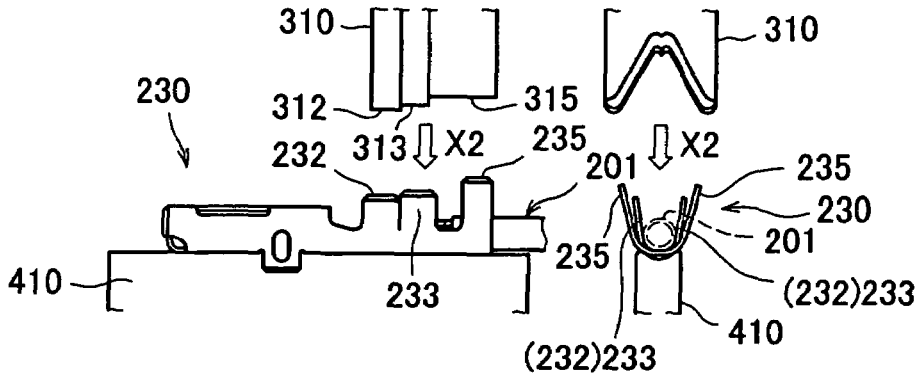
FIG. 14 is a process view showing a terminal crimping method onto aluminum electric-wire according to the second embodiment of the present invention, in a sequence of FIG. 14A through FIG. 14D.
Figure 14B:
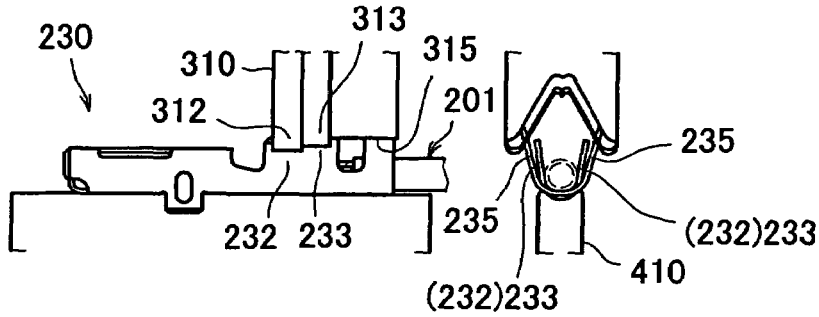
Figure 15A:
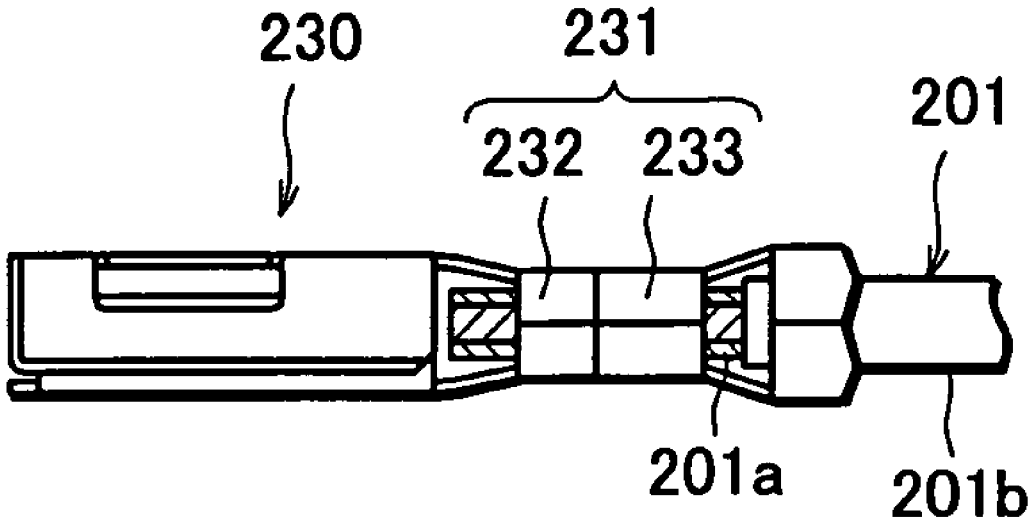
FIG. 15 includes a plan view (FIG. 15A) and a side view (FIG. 15B) showing a state where the aluminum-electric-wire crimping terminal shown in FIG. 14 is crimped onto an aluminum electric-wire.

There will be explained hereinafter a process for crimping such an aluminum-electric-wire crimping terminal 230 onto the aluminum electric-wire 201 in this embodiment. Firstly, as shown in FIG. 14A, the aluminum-electric-wire crimping terminal 230 is fixed to a base 410, and the aluminum electric-wire 201 is suitably positioned relative to the aluminum-electric-wire crimping terminal 230. Namely, the aluminum electric-wire 201 has a coating part 201*b* (see FIG. 15A) positioned in a region embraced by an insulation barrel 235, and an electrical conductor part 201*a* positioned in a region embraced by the conducting barrel 232 and retaining barrel 233.

Figure 14C:
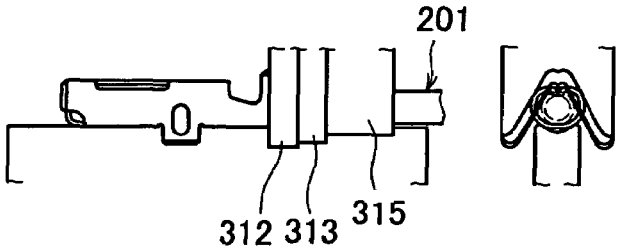
Figure 14D:
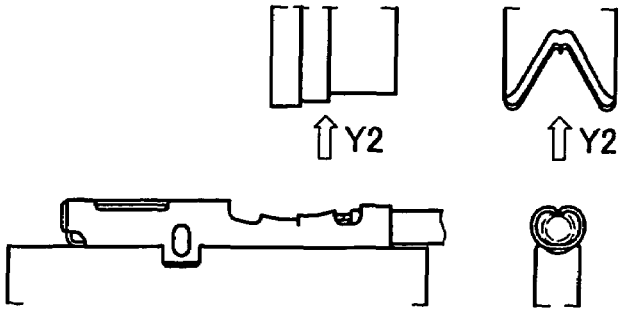

In this state, the crimping jig 310 having crimping grooves each having an inverted "V" shape as a whole and having an "M" shape at an apex thereof when viewed in the terminal-wise longitudinal direction, is brought toward the terminal from the above (see an arrow X2 representing a terminal crimping direction in FIG. 14A). As apparent from FIG. 14, the crimping jig 310 is formed with crimping portions 312, 313, 315 corresponding to the three pieces of conducting barrel 232, retaining barrel 233 and insulation barrel 235 to be crimped, respectively. Namely, in the terminal crimping direction, the crimping portion 312 corresponding to the conducting barrel 232 is formed to protrude most, the crimping portion 313 corresponding to the retaining barrel 233 is protruded more, and the crimping portion 315 corresponding to the insulation barrel 235 is formed to be retracted most. Further, this crimping jig 310 is lowered toward the terminal side by an actuator not shown (see the arrow X2 in FIG. 14A). This lowering operation causes the end portions of the barrels 232, 233, 235 to be gradually curled along crimping grooves in the inverted "V" shapes of the crimping jig 310, respectively, and the barrel end portions are deformed (curled) in due course toward a central axis direction of the aluminum electric-wire 201 at the tip end portions in the "M" shapes of the crimping jig 310, respectively, as shown in FIG. 14C. Further lowering the crimping jig 310 crimps the conducting barrel 232 and retaining barrel 233 onto the aluminum electric-wire's conductor part 201*a*, and also crimps the insulation barrel 235 onto the coating part 201*b* of the aluminum electric-wire 201. When the terminal crimping operation is finished, the crimping jig is raised as shown in FIG. 14D to thereby complete the terminal crimping process (see an arrow Y2 in the figure).

Figure 15B:
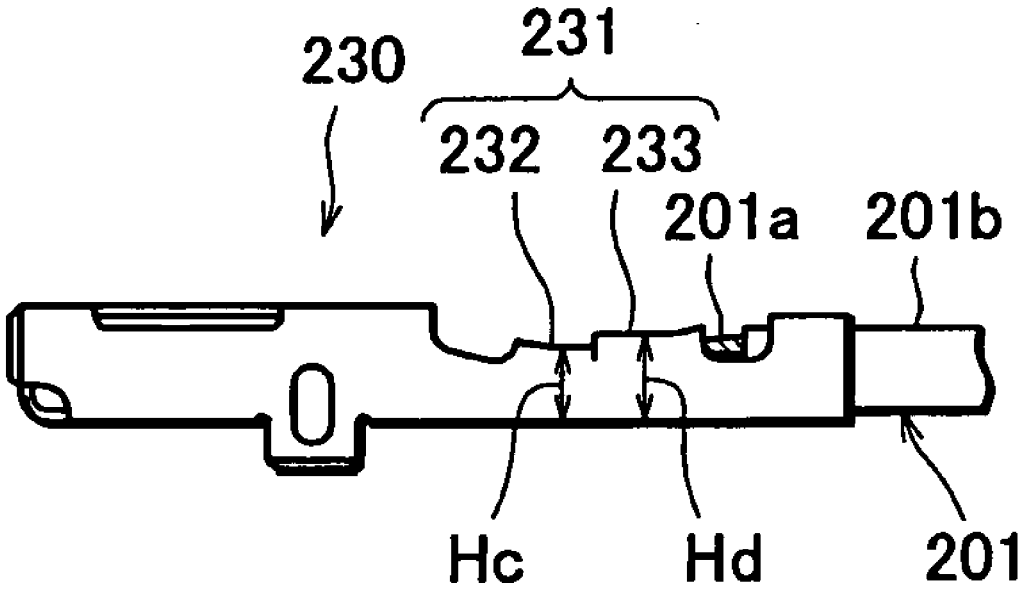

As a result, the crimping is performed such that the crimped terminal region corresponding to the conducting barrel 232 has a height lower than that of the crimped terminal region corresponding to the retaining barrel 233, when viewed in the terminal crimping direction as shown in FIG. 15B (cf. height Hc and height Hd in the figure).

Concretely, the crimping is performed such that the compressed ratio of the aluminum electric-wire's conductor part 201*a* at the portion to be crimped by the conducting barrel 232 falls within a range of 50 to 70%, in terms of the ratio of the (cross-sectional area of aluminum electric-wire's conductor part at crimped portion)/(cross-sectional area of aluminum electric-wire's conductor part before crimping).

Meanwhile, when the cross-sectional area of the aluminum electric-wire's conductor part to be crimped by the conducting barrel 232 is 1.5 $mm^2$ or more, the range of the compressed ratio is widened to a range of 40% to 70%, in terms of the ratio of the (cross-sectional area of aluminum electric-wire's conductor part at crimped portion)/(cross-sectional area of aluminum electric-wire's conductor part before crimping).

Further, when the cross-sectional area of the aluminum electric-wire's conductor part 201*a* to be crimped by the conducting barrel 232 is 1.5 $mm^2$ or more, the compressed ratio of the aluminum electric-wire's conductor part 201*a* at the portion to be crimped by the conducting barrel 232 may have the upper limit value of 70% in terms of the ratio of the (cross-sectional area of aluminum electric-wire's conductor part at crimped portion)/(cross-sectional area of aluminum electric-wire's conductor part before crimping), and a lower limit value where the terminal crimping strength becomes 100N.

Note that, also in the following modifications, the conducting barrel or the portion corresponding thereto shall be crimped at the above described compressed ratios (typically, within the range of 50 to 70%; and, when the cross-sectional area of the aluminum electric-wire's conductor part is 1.5 $mm^2$ or more, within the range of 40% to 70%, or within the range including the upper limit value of 70% and the lower limit value where the terminal crimping strength becomes 100N) correspondingly to the sizes of aluminum electric-wires.

In this way, the aluminum electric-wire's conductor part 201*a* drawn out of the coating part 201*b* is firmly retained at the crimped terminal region corresponding to the retaining barrel 233 for a long period of time, without overstrain on the electrical conductor part in terms of mechanical strength. Simultaneously therewith, at the crimped terminal region corresponding to the conducting barrel 232 formed at the end portion side of the aluminum electric-wire and neighbored to the retaining barrel 233, the terminal is crimped onto the aluminum electric-wire's conductor part 201*a* at the compressed ratio (surface-area reducing ratio) (i.e., the compressed ratio, typically within the range of 50 to 70%; and, when the cross-sectional area of the aluminum electric-wire's conductor part is 1.5 $mm^2$ or more, within the range of 40% to 70%, or within the range including the upper limit value of 70% and the lower limit value where the terminal crimping strength becomes 100N), which is so high that the oxide film of the aluminum electric-wire's conductor part 201*a* is broken and the barrel is closely contacted with the conductor part, thereby enabling obtainment of a sufficient electric conducting property at this portion.

Figure 16A:
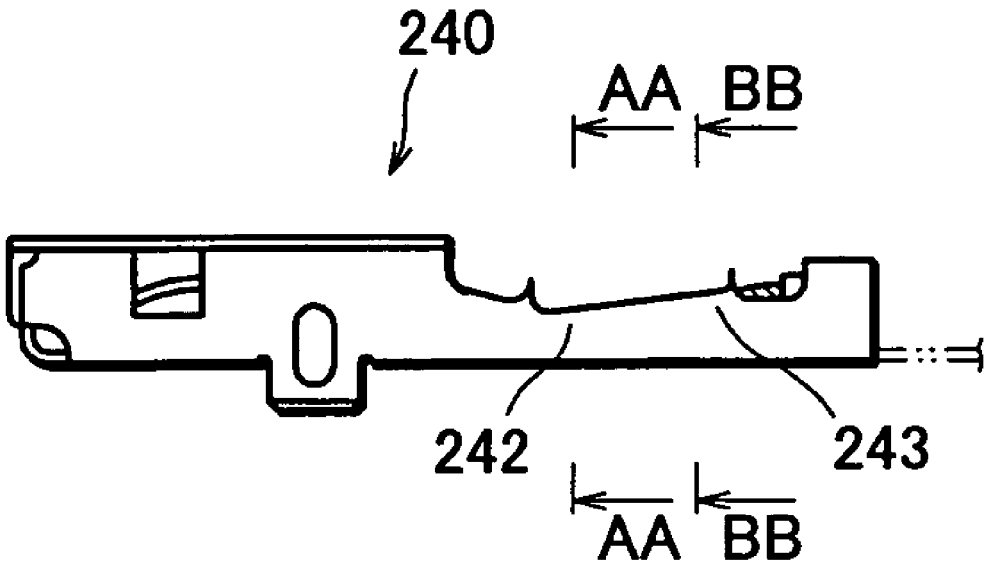
FIG. 16 includes a side view (FIG. 16A) as well as AA-AA cross-sectional view and BB-BB cross-sectional view (FIG. 16B) in FIG. 16A, showing an aluminum-electric-wire crimping terminal according to a first modification of the second embodiment, in a state crimped onto an aluminum electric-wire.

Note that, instead of adopting the stepped crimping jig 320 for the aluminum-electric-wire crimping terminal 230 shown in FIG. 13, it is possible to employ a crimping jig (not shown) as a first modification of the second embodiment, which includes a single groove in an inverted "V" shape as a whole and having an "M" shape at an apex of the inverted "V" shape (i.e., having an "M" shaped groove bottom) such that the groove depth varies continuously, when viewed in the longitudinal direction of the terminal to be crimped. Namely, in realizing a state of a terminal crimped onto an aluminum electric-wire as shown in FIG. 16, it is possible to exemplarily employ such a crimping jig (not shown here) that the groove depth of the crimping groove in the inverted "V" shape of the jig is formed to be continuously deepened toward an insulative coating of the aluminum electric-wire to be crimped (i.e., the groove depth of the crimping groove in the inverted "V" shape of the jig is formed to be continuously shallowed toward the tip end of the aluminum electric-wire). By utilizing such a crimping jig, the terminal even having a conducting barrel 242 and a retaining barrel 243 integrally formed as a wire barrel can be eventually crimped as shown in FIG. 16A, in which the conducting barrel 242 has a height continuously lower than that of the retaining barrel 243 when viewed in the terminal crimping direction, as the conducting barrel extends to the tip end of the aluminum electric-wire.

Note that the compressed ratio of the electric-wire's conductor part crimped with the conducting barrel 242 is the same as the compressed ratio in the second embodiment, also in this case.

Figure 16B:
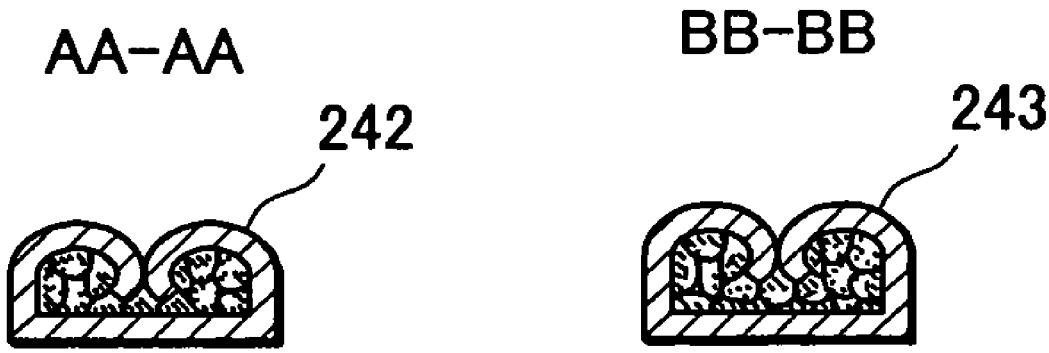

FIG. 16B shows a cross-section of an aluminum-electric-wire crimping terminal 240 in a state crimped in the above manner. As apparent from this figure, the terminal is crimped by a fairly strong force at the crimping region corresponding to the conducting barrel 242 (see AA-AA cross-sectional view in FIG. 16B), thereby enabling a sufficient electric conduction of the barrel with the aluminum electric-wire (not shown here).

Concretely, the compressed ratio of the aluminum electric-wire's conductor part to be crimped with the conducting barrel is within a range of 50 to 70%, in terms of the ratio of (cross-sectional area of aluminum electric-wire's conductor part at crimped portion)/(cross-sectional area of aluminum electric-wire's conductor part before crimping). Note that the lower limit value of the range of the compressed ratio at this portion is widened to 40% when the cross-sectional area of the aluminum electric-wire's conductor part to be crimped is 1.5 $mm^2$ or more. Alternatively, the lower limit value of the compressed ratio at this portion may be set at a compressed ratio where the terminal crimping strength becomes 100N.

Meanwhile, in the crimped region corresponding to the retaining barrel 243, this retaining barrel is crimped at a compressed ratio (surface-area reducing ratio) which is not so high as the conducting barrel 242 (see BB-BB cross-sectional view in FIG. 16B). This enables the aluminum electric-wire to be firmly retained at the retaining barrel 243 for a long period of time, without overstrain on the aluminum electric-wire's conductor part drawn out of the aluminum electric-wire's coating part in terms of mechanical strength. Further, the region corresponding to the conducting barrel 242 is crimped at a higher compressed ratio (surface-area reducing ratio) as the conducting barrel extends to the end portion side of the aluminum electric-wire, thereby breaking the oxide film on the aluminum electric-wire and enabling a sufficient electric conduction.

Note that, instead of devising the crimping groove shape at the crimping jig side, i.e., instead of providing the crimping jig with the specific stepped portions or with the groove portion having a depth varying in the terminal-wise longitudinal direction, it is possible to obtain the same functions and effects by devising the shape of the wire barrel of the aluminum-electric-wire crimping terminal as a second modification of the second embodiment as explained hereinafter.

Figure 17A:
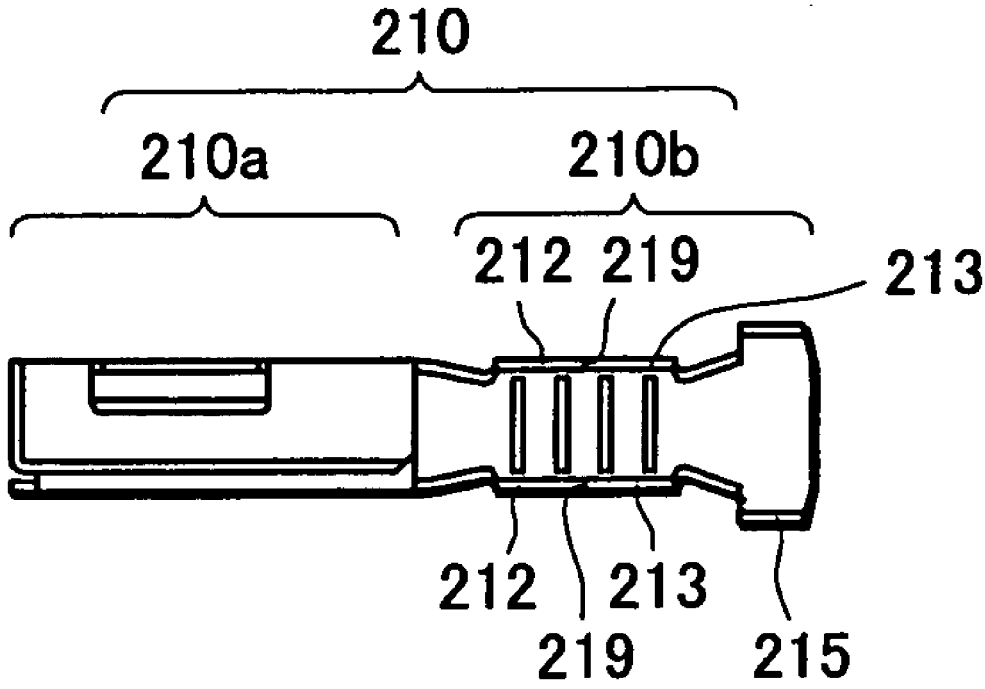
FIG. 17 includes a plan view (FIG. 17A) and a side view (FIG. 17B) showing an aluminum-electric-wire crimping terminal according to a second modification of the second embodiment shown in FIG. 13.
Figure 17B:
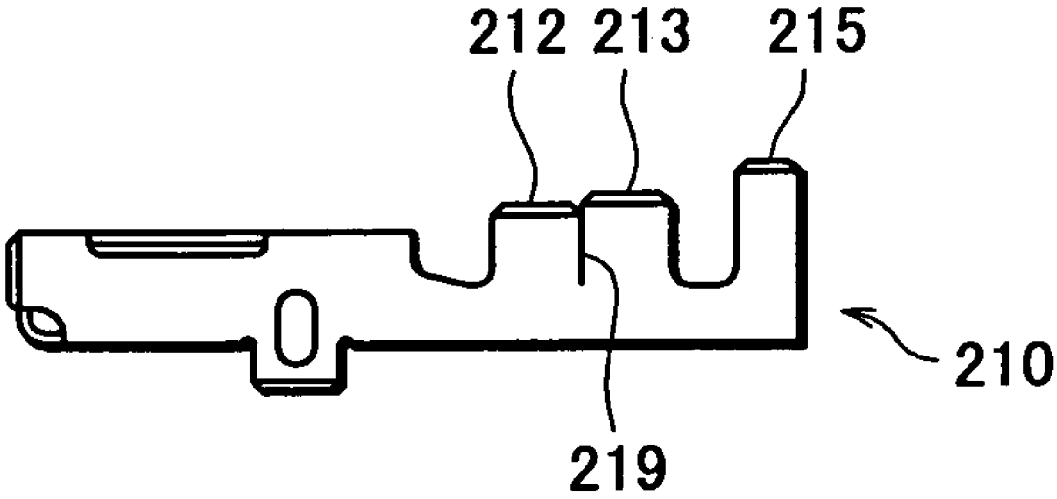
Figure 19A:
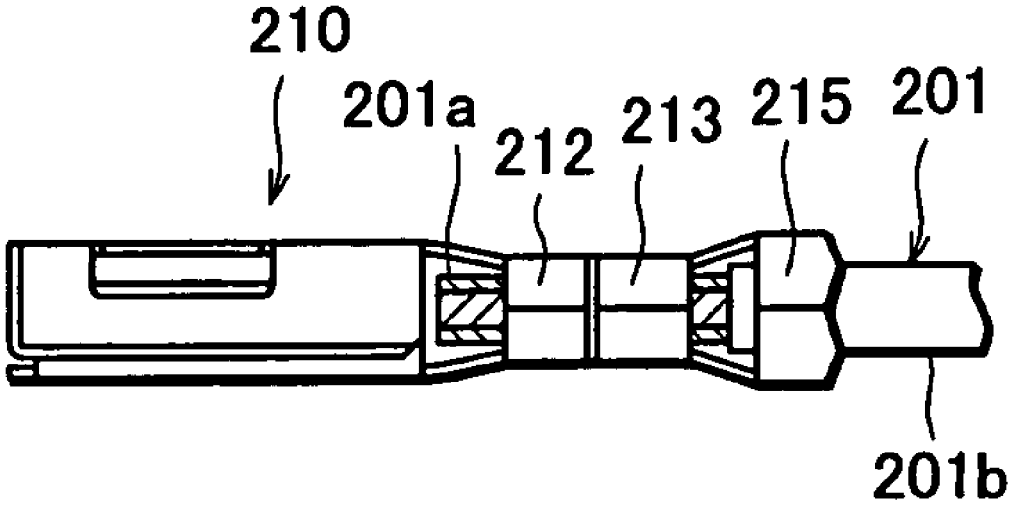
FIG. 19 includes a plan view (FIG. 19A) and a side view (FIG. 19B) showing a state where the aluminum-electric-wire crimping terminal shown in FIG. 17 is crimped onto an aluminum electric-wire.

There will be explained hereinafter such a second modification of the second embodiment. FIG. 17 includes a plan view (FIG. 17A) and a side view (FIG. 17B) of an aluminum-electric-wire crimping terminal 210 concerning the second modification of the second embodiment. As apparent from this figure, the aluminum-electric-wire crimping terminal 210 is constituted of an inter-terminal connecting portion 210*a* formed at one side in the longitudinal direction of the terminal, and an electric-wire connecting portion 210*b* formed at the other side in the longitudinal direction, and the electric-wire connecting portion 210*b* comprises: an insulation barrel 215 to be crimped onto a coating part of the aluminum electric-wire; and conducting barrel 212 and retaining barrel 213 formed between the inter-terminal connecting portion 210*a* and insulation barrel 215. Note that the conducting barrel 212 is formed at the inter-terminal connecting portion side, i.e., at the tip end portion side of the aluminum electric-wire 201 to be crimped (see FIG. 19), and the retaining barrel 213 is formed at the insulation barrel side, i.e., near the coating part of the aluminum electric-wire 201. Further, the conducting barrel 212 and retaining barrel 213 are neighbored to each other, with a narrow slit 219 formed therebetween in this modification.

Figure 18A:
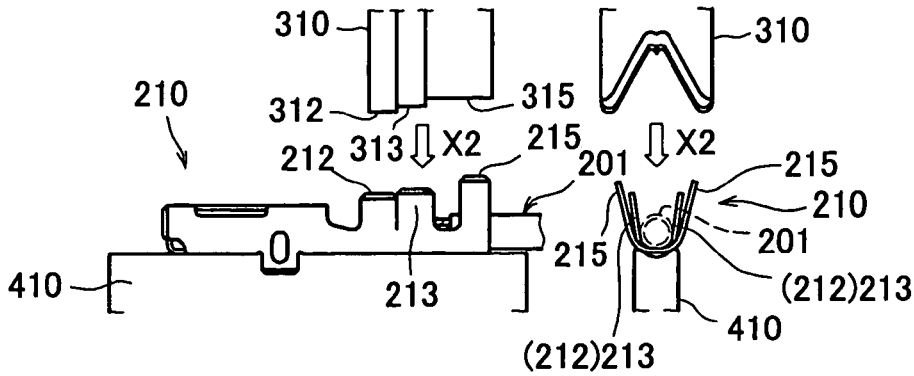
FIG. 18 is an explanatory process view showing a crimping process of the aluminum-electric-wire crimping terminal shown in FIG. 17.
Figure 18B:
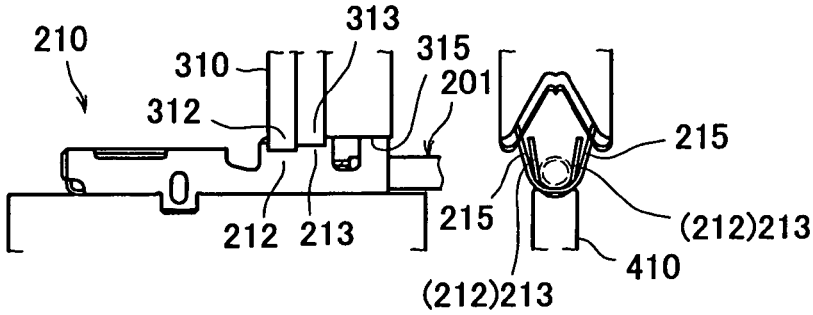
Figure 18C:
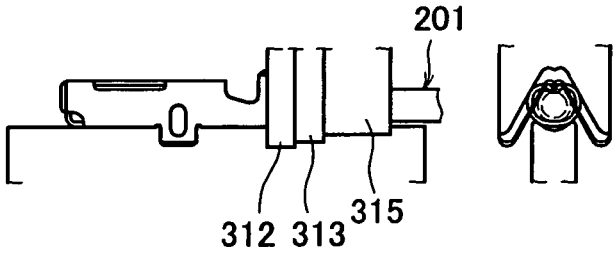
Figure 18D:
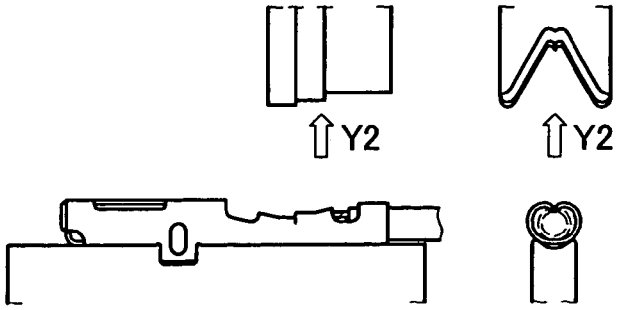

There will be explained hereinafter a process for crimping the aluminum-electric-wire crimping terminal 210 according to the second modification onto the aluminum electric-wire 201. Firstly, as shown in FIG. 18A, the aluminum-electric-wire crimping terminal 210 is fixed to a base 410, and the aluminum electric-wire 201 is suitably positioned relative to the aluminum-electric-wire crimping terminal 210. Namely, the aluminum electric-wire 201 has a coating part 201*b* (see FIG. 19A) positioned in a region embraced by the insulation barrel 215, and an electrical conductor part 201*a* (see FIG. 19A) positioned in a region embraced by the conducting barrel 212 and retaining barrel 213. In this state, the crimping jig 310 having crimping grooves each having an inverted "V" shape as a whole and having an "M" shape at an apex thereof when viewed in the terminal-wise longitudinal direction, is brought toward the terminal from the above (see an arrow X2 representing a terminal crimping direction in FIG. 18A). As apparent from FIG. 18, the crimping jig 310 is formed with crimping portions 312, 313, 315 corresponding to the three pieces of conducting barrel 212, retaining barrel 213 and insulation barrel 215 to be crimped, respectively. Namely, in the terminal crimping direction, the crimping portion 312 corresponding to the conducting barrel 212 is formed to protrude most, the crimping portion 313 corresponding to the retaining barrel 213 is protruded more, and the crimping portion 315 corresponding to the insulation barrel 215 is formed to be retracted most. Further, this crimping jig 310 is lowered toward the terminal side by an actuator not shown (see the arrow X2 in FIG. 18A). This lowering operation causes the end portions of the barrels 212, 213, 215 to be gradually curled along crimping grooves in the inverted "V" shapes of the crimping jig 310, respectively, and the barrel end portions are deformed (curled) in due course toward a central axis direction of the aluminum electric-wire 201 at the tip end portions in the "M" shapes of the crimping jig 310, respectively, as shown in FIG. 18C. Further lowering the crimping jig 310 crimps the conducting barrel 212 and retaining barrel 213 onto the aluminum electric-wire's conductor part 201*a*, and also crimps the insulation barrel 215 onto the coating part 201*b* of the aluminum electric-wire 201. When the terminal crimping operation is finished, the crimping jig is raised as shown in FIG. 18D to thereby complete the terminal crimping process (see an arrow Y2 in the figure).

Figure 19B:
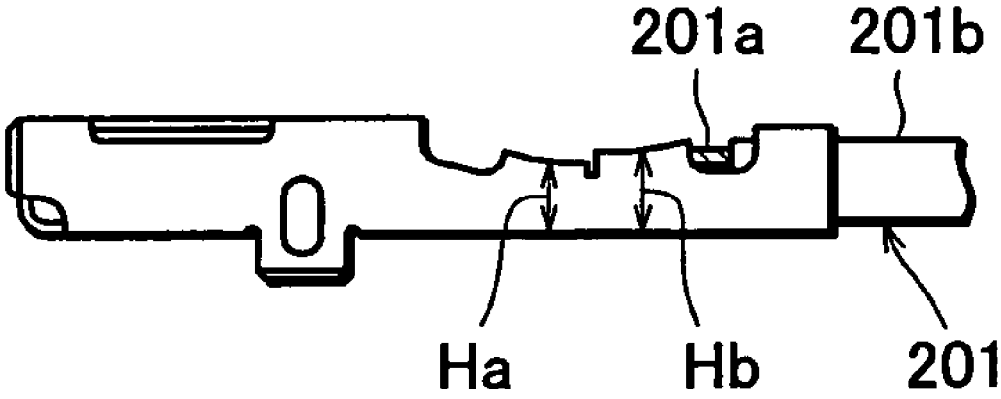

FIG. 19 shows a terminal crimping structure of the aluminum electric-wire 201 crimped with the terminal in the above manner. By using the specific crimping jig 310 shown in FIG. 18, the crimped portion of the conducting barrel 212 is crimped onto the aluminum electric-wire 201 at a compressed ratio (surface-area reducing ratio) higher than the crimped portion of the retaining barrel 213, resulting in that the conducting barrel 212 has a crimp height lower than that of the retaining barrel 213 when viewed in the terminal crimping direction.

Concretely, the compressed ratio of the aluminum electric-wire's conductor part to be crimped with the conducting barrel 212 is within a range of 50 to 70%, in terms of the ratio of (cross-sectional area of aluminum electric-wire's conductor part at crimped portion)/(cross-sectional area of aluminum electric-wire's conductor part before crimping). Meanwhile, the lower limit value of the range of the compressed ratio at this portion is widened to 40% when the cross-sectional area of the aluminum electric-wire's conductor part to be crimped is 1.5 $mm^2$ or more. Alternatively, the lower limit value of the compressed ratio at this portion may be set at a compressed ratio where the terminal crimping strength becomes 100N.

Namely, the retaining barrel 213 is crimped at a compressed ratio (surface-area reducing ratio) which is not so high as the conducting barrel 212. Thus, the electrical conductor part 201*a* drawn out of the coating part 201*b* of the aluminum electric-wire 201 is crimped with the conducting barrel 212 at a higher compressed ratio (surface-area reducing ratio), and retained by the retaining barrel 213. Therefore, the terminal 210 retains the aluminum electric-wire 201 without overstrain thereon in terms of mechanical strength at the crimped portion of the retaining barrel 213, and the terminal 210 is crimped onto the aluminum electric-wire 201 at a compressed ratio (surface-area reducing ratio) sufficient for breaking the surface oxide film of the aluminum electric-wire 201 and being closely contacted with the aluminum electric-wire 201 at the crimped portion of the conducting barrel 212 neighboring to the retaining barrel 213. Such stepwise crimping makes it possible to solve the problems all at once, such as deteriorated terminal-retaining forces due to excessive compressed ratios (surface-area reducing ratios) of the aluminum electric-wire, and defective conduction due to insufficient compressed ratios (surface-area reducing ratios).

There will be explained hereinafter a third modification of the second embodiment, based on FIG. 20 through FIG. 22. Note that those same constituent elements as the aluminum-electric-wire crimping terminal 210 shown in FIG. 17 are represented by the corresponding reference numerals, respectively, and the detailed explanation thereof shall be omitted.

Figure 20A:
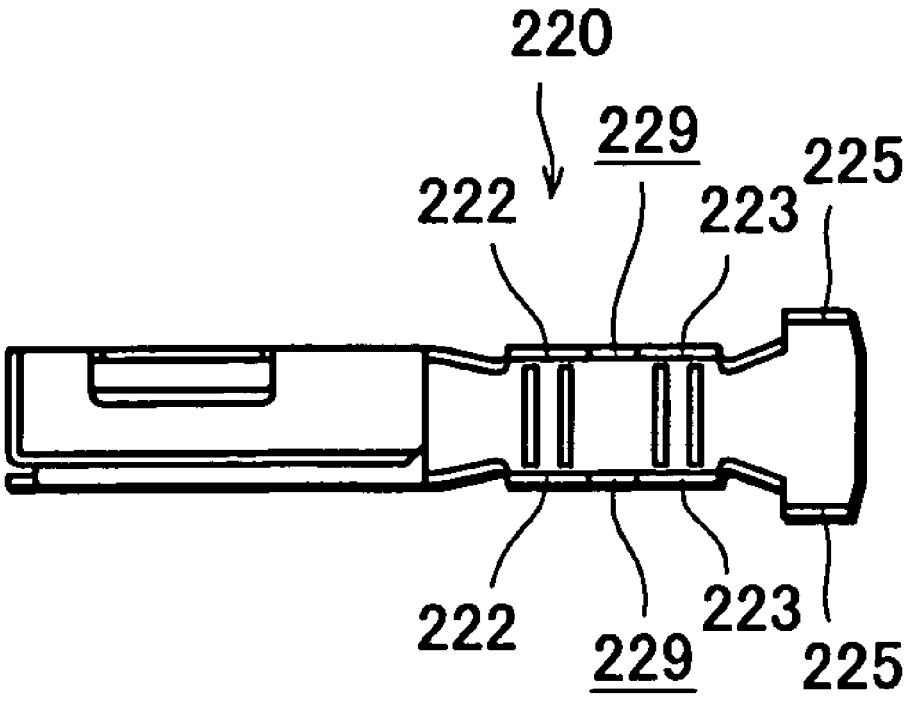
FIG. 20 includes a plan view (FIG. 20A) and a side view (FIG. 20B) of an aluminum-electric-wire crimping terminal according to a third modification of the second embodiment.
Figure 20B:
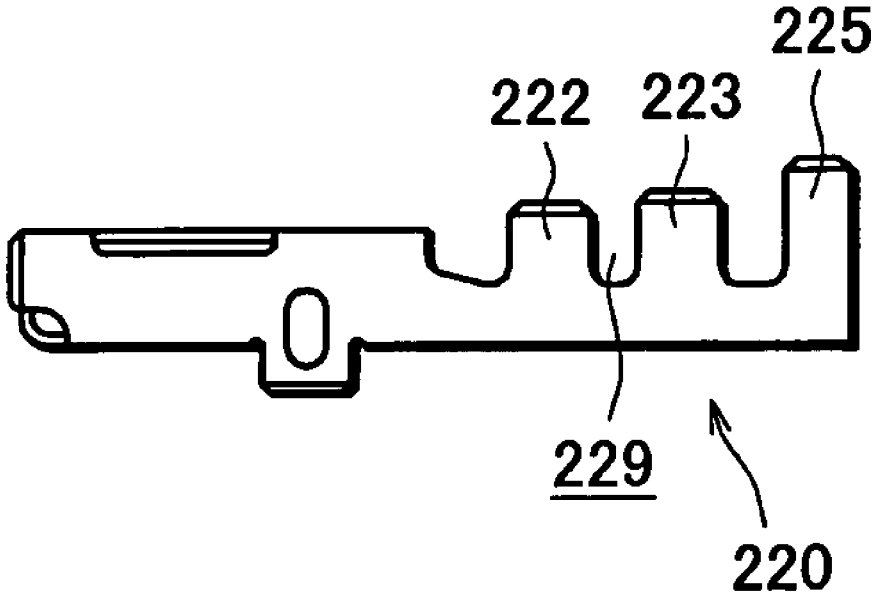
Figure 21A:
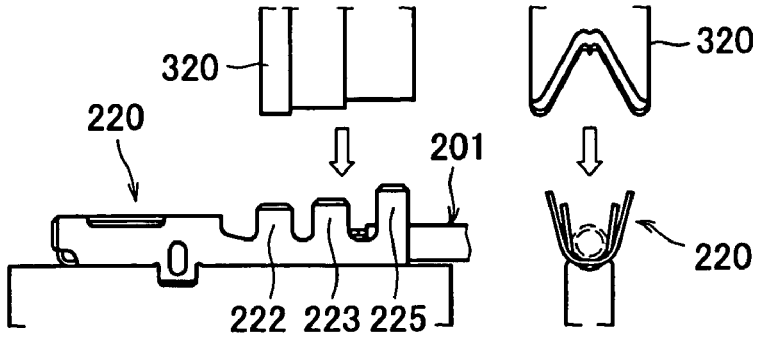
FIG. 21 is an explanatory process view of a process for crimping the aluminum-electric-wire crimping terminal shown in FIG. 20 onto an aluminum electric-wire, in a process sequence of FIG. 21A through FIG. 21D.
Figure 21B:
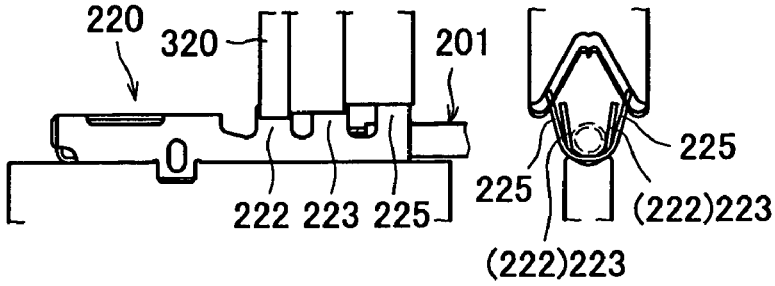
Figure 21C:
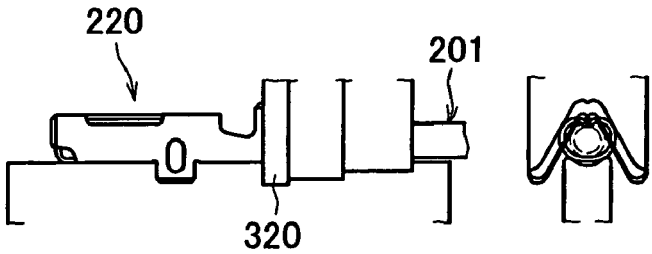
Figure 21D:
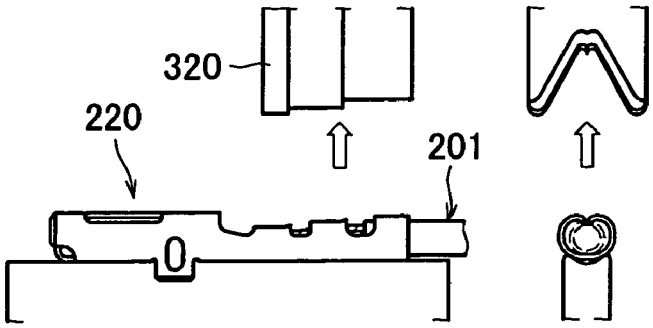

Although FIG. 20 shows an aluminum-electric-wire crimping terminal 220 having the same basic constitution as the aluminum-electric-wire crimping terminal 210 shown in FIG. 17, this terminal 220 includes a conducting barrel 222 and a retaining barrel 223 and is formed with a slit 229 therebetween which is wider than the slit 219 of the aluminum-electric-wire crimping terminal 210 shown in FIG. 17 (see FIG. 20B).

As shown in FIG. 21A through FIG. 21D providing a terminal crimping process view, adoption of the above constitution enables the conducting barrel 222 to be crimped at a higher compressed ratio (surface-area reducing ratio) and enables the retaining barrel 223 to be crimped at a compressed ratio (surface-area reducing ratio) lower than the conducting barrel 222, even when a slight positional discrepancy is caused between: the conducting barrel 222 and retaining barrel 223 of the aluminum-electric-wire crimping terminal 220 to be crimped; and a specifically stepped crimping jig 320; upon crimping the conducting barrel 222, retaining barrel 223 and insulation barrel 225 by utilizing the crimping jig 320.

Figure 22A:
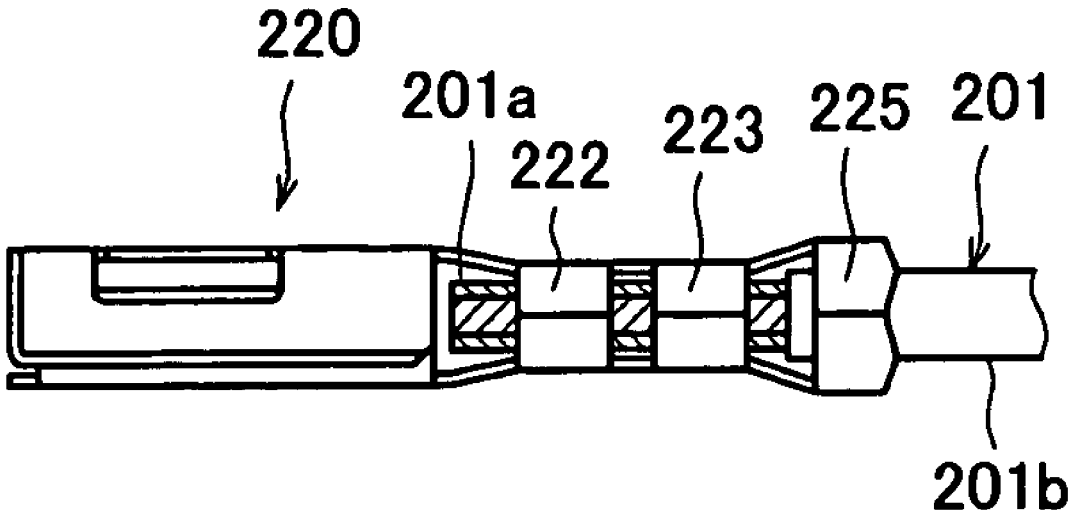
FIG. 22 includes a plan view (FIG. 22A) and a side view (FIG. 22B) showing a state where the aluminum-electric-wire crimping terminal shown in FIG. 20 is crimped onto an aluminum electric-wire.
Figure 22B:
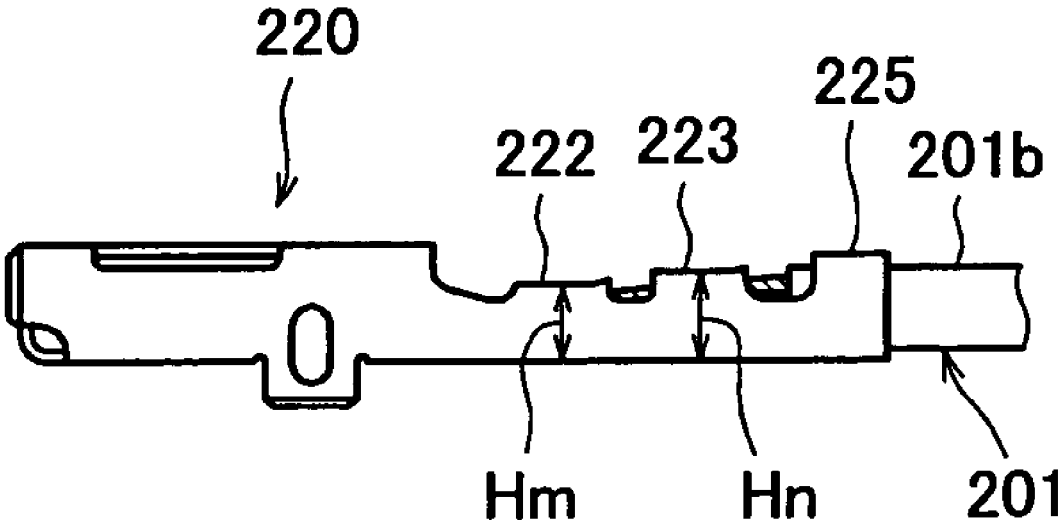

FIG. 22 shows a state of the terminal crimped onto the aluminum electric-wire 201 achieved by such a crimping jig 320. As apparent from FIG. 22B, when comparing the crimped portion of the conducting barrel 222 with that of the retaining barrel 223, the crimped portion of the conducting barrel 222 is crimped at a height lower than that of the crimped portion of the retaining barrel 223 when viewed in the terminal crimping direction (cf. height Hm and height Hn in FIG. 22B). Namely, the aluminum electric-wire's conductor part 201*a* drawn out of the coating part 201*b* of the aluminum electric-wire 201 is retained at the crimped portion of the retaining barrel 223, by a sufficient retaining force without overstrain on the conductor part in terms of mechanical strength. Simultaneously therewith, at the crimped portion of the conducting barrel 222 formed to be more neighbored to the end portion side of the aluminum electric-wire than the retaining barrel 223, the conducting barrel is crimped onto the electrical conductor part 201*a* of the aluminum electric-wire 201 at a compressed ratio (surface-area reducing ratio) which is so high that the surface oxide film of the electrical conductor part is broken and the conducting barrel is closely contacted therewith, thereby resultingly achieving a sufficient electric conducting property at this portion.

Concretely, the compressed ratio of the aluminum electric-wire's conductor part at the portion to be crimped with the conducting barrel, is the same as those in the second embodiment and the first and second modifications thereof.

There will be explained hereinafter a fourth modification of the second embodiment. Also this fourth modification exhibits the same functions and effects as the above, by devising the wire barrel shape of an aluminum-electric-wire crimping terminal 250 as shown in FIG. 23.

Figure 23A:
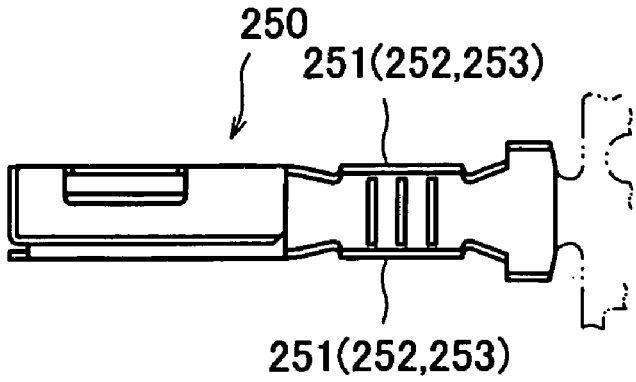
FIG. 23 includes a plan view (FIG. 23A) and a side view (FIG. 23B) showing an aluminum-electric-wire crimping terminal according to a fourth modification of the second embodiment, and a deployed state view (FIG. 23C) of the crimping terminal.
Figure 23B:
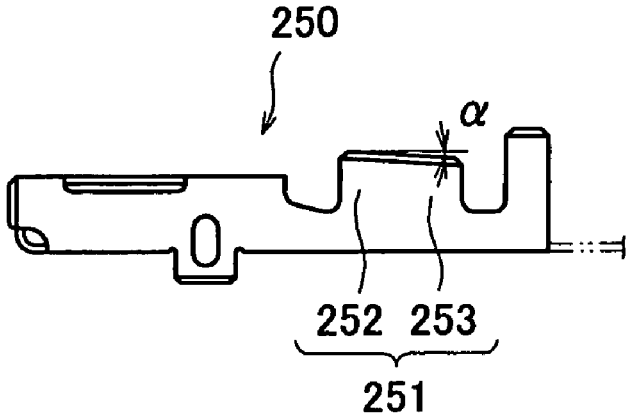
Figure 23C:
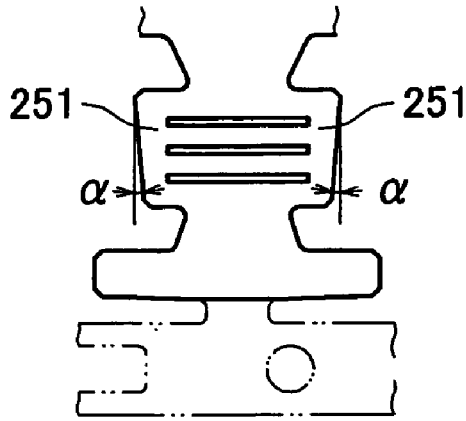

In this fourth modification, the aluminum-electric-wire crimping terminal 250 includes an electroconductive barrel 251 comprising a conducting barrel 252 and a retaining barrel 253 integrated with each other as shown in FIG. 23, and the portion corresponding to the conducting barrel 252 is formed in an upstanding state higher than the portion corresponding to the retaining barrel 253 (see angle $\alpha$ in FIG. 23B, FIG. 23C). Namely, the wire barrel 251 is formed to have a height gradually increased as the wire barrel extends to the tip end portion of the aluminum electric-wire to which the wire barrel is crimped.

Figure 24A:
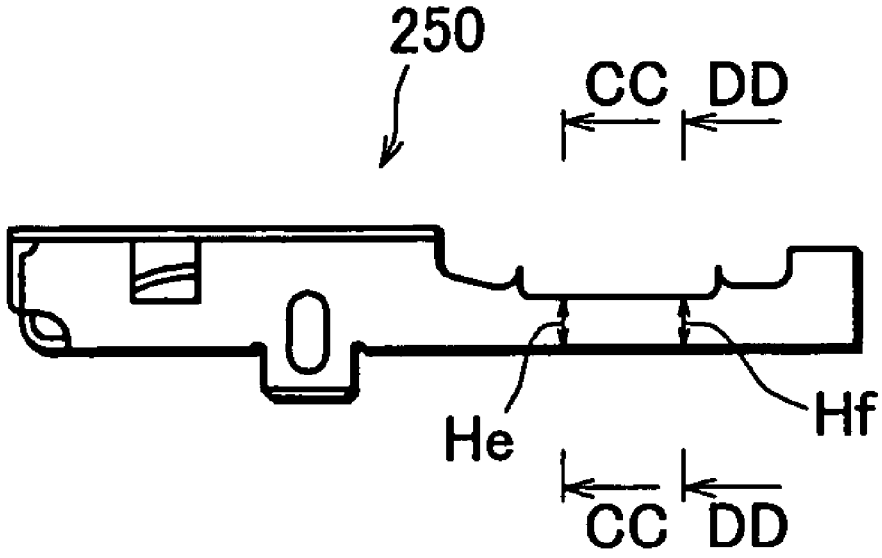
FIG. 24 includes a side view (FIG. 24A) showing the aluminum-electric-wire crimping terminal of FIG. 23 in a state crimped onto an aluminum electric-wire, as well as CC-CC cross-sectional view and DD-DD cross-sectional view (FIG. 24B) showing predetermined cross-sectional views thereof.
Figure 24B:
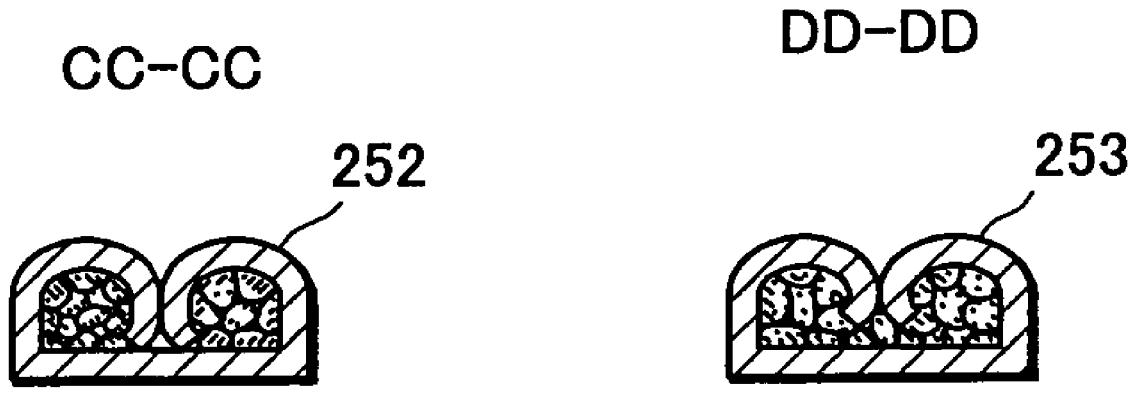

When the crimping is performed by the conventional crimping jig 380 shown in FIG. 2, the crimped portion corresponding to the conducting barrel 252 is rendered to have the same height as the crimped portion corresponding to the retaining barrel 253 when viewed in the terminal crimping direction as shown in FIG. 24A (cf. height He and height Hf in FIG. 24A). However, since the length of the region of the conducting barrel 252 in the terminal crimping direction is formed to be longer than that of the region of the retaining barrel 253, the terminal tip end portion in the region of the conducting barrel 252 bites into the strands (not shown) of the aluminum electric-wire, at a depth deeper than that of the terminal tip end portion in the region of the retaining barrel 253 as understood from the comparative cross-sectional view of the terminal in the crimped state shown in FIG. 24B. This enables the aluminum electric-wire to be firmly retained over a long period of time, without exerting an excessive stress on the aluminum electric-wire (not shown) in the region corresponding to the retaining barrel 253. Further, in the region corresponding to the conducting barrel 252, the terminal is contacted with more strands (wire-elements) of the aluminum electric-wire, and simultaneously therewith, the terminal is crimped at a compressed ratio to break the surface oxide of the electric-wire and to be closely contacted therewith, thereby allowing obtainment of a sufficient electric conducting property.

Concretely, the compressed ratio of the aluminum electric-wire's conductor part at the portion to be crimped with the conducting barrel, is the same as those in the second embodiment and the first through third modifications thereof.

As described above, the shape of the crimping jig is devised or the shape of the wire barrel of the aluminum-electric-wire crimping terminal is devised, to thereby stepwise or continuously increase the compressed ratio (surface-area reducing ratio) of the aluminum electric-wire from the crimped portion of the retaining barrel toward the crimped portion of the conducting barrel, thereby ensuring a sufficient electric conducting property while maintaining the firm retainment of the terminal over a long period of time.

Further, when a wire harness provided with aluminum electric-wires is crimped with such terminals based on the above described process, it becomes possible to produce a wire harness having a sufficient mechanical strength and electric conducting property. When such a wire harness is arranged to a vehicle, the thus produced wire harness has a sufficient strength capable of withstanding an arranging operation, thereby enabling realization of an arranging operation of a wire harness having an excellent conducting property and reliability over a long period of time.

Note that, although the inter-terminal connecting portion of the crimping terminal shown in this embodiment is of a female shape (tongue-flap spring structure) in a conventional type of crimping terminal, the present invention is not necessarily limited thereto and it is also possible to utilize a male shape for this portion so that various old and new terminal structures are usable as the inter-terminal connecting portion.

Further, it is preferable to avoid a different kind of metal as an applicable terminal material from a standpoint of preventing electric corrosion, and it is thus preferable to employ an aluminum alloy based terminal, without necessarily limited to such a material.

Moreover, although sufficient electric conducting properties can be obtained by crimping the conducting barrels of the terminals onto aluminum electric-wires at the above described compressed ratios, it becomes possible to attain a higher reliability by additionally and exemplarily coating anti-rust grease to the terminal connecting portion or terminal-crimped portion so as to prevent oxidation due to air or corrosion due to moisture at the terminal connecting portion.

Although the present invention is applicable to crimping terminals for connectors capable of being inserted into and extracted from each other so as to mutually connect aluminum electric-wires utilizing aluminum as electrical conductors, the main usage is not limited to in-vehicle arrangement of wire harnesses and is applicable to various fields where terminals are crimped onto end portions of aluminum electric-wires.

We claim:

1. A terminal crimping structure for crimping a terminal onto an aluminum electric-wire, comprising:

an aluminum electric wire including an electric conductor part including numerous strands and a coating part coated on the electric conductor part;

a terminal having an open wire barrel to be directly crimped onto said electrical conductor part of said aluminum electric-wire and an insulation barrel to be directly crimped onto said coating part of said aluminum electric-wire, said wire barrel having an aluminum-electric-wire retaining crimp barrel and an aluminum-electric-wire conducting crimp barrel;

wherein said aluminum-electric-wire conducting crimp barrel and said aluminum-electric-wire retaining crimp barrel are formed integrally with each other as a wire barrel, a region of said wire barrel having a smaller height corresponds to said aluminum-electric-wire conducting crimp barrel and a region of said wire barrel having a larger height corresponds to said aluminum-electric-wire retaining crimp barrel, when viewed in the terminal crimping direction in the state where said terminal is crimped onto said electric conductor part, said aluminum-electric-wire retaining crimp barrel having a higher value of compressed ratio than said aluminum-electric-wire conducting crimp barrel so as to ensure crimping of said aluminum-electric-wire by said terminal, said compressed ratio defined by (cross-sectional area of aluminum electric-wire conductor part at crimped portion)/(cross-sectional area of aluminum electric-wire conductor part before crimping), and said value of compressed ratio of said aluminum-electric-wire conducting crimp barrel is enough to break an oxide film of said electric wire's conductor part.

2. The terminal crimping structure of claim 1, wherein, after said terminal is crimped, the compressed ratio of an aluminum electric-wire's conductor part in the region of said wire barrel having the smaller height is within a range of 50 to 70%, in terms of the ratio of (cross-sectional area of aluminum electric-wire's conductor part at crimped portion)/(cross-sectional area of aluminum electric-wire's conductor part before crimping).

3. The terminal crimping structure of claim 1, wherein the cross-sectional area of an aluminum electric-wire's conductor part to be crimped with said aluminum-electric-wire conducting crimp barrel is 1.5 $mm^2$ or more, and, after said terminal is crimped, the compressed ratio of the aluminum electric-wire's conductor part in the region of said wire barrel having the smaller height is within a range of 40 to 70%, in terms of the ratio of (cross-sectional area of aluminum electric-wire's conductor part at crimped portion)/(cross-sectional area of aluminum electric-wire's conductor part before crimping).

4. The terminal crimping structure of claim 1, wherein the cross-sectional area of an aluminum electric-wire's conductor part to be crimped with said aluminum-electric-wire conducting crimp barrel is 1.5 $mm^2$ or more, and, after said terminal is crimped, the compressed ratio of the aluminum electric-wire's conductor part in the region of said wire barrel having the smaller height has an upper limit value of 70% in terms of the ratio of the (cross-sectional area of aluminum electric-wire's conductor part at crimped portion)/(cross-sectional area of aluminum electric-wire's conductor part before crimping), and a lower limit value where the terminal crimping strength becomes 100N.

5. A terminal crimping structure for crimping a terminal onto an aluminum electric-wire, comprising:

an aluminum electric wire including an electric conductor part including numerous strands and a coating part coated on the electric conductor part;

a terminal having an open wire barrel to be directly crimped onto said electrical conductor part of said aluminum electric-wire and an insulation barrel to be directly crimped onto said coating part of said aluminum electric-wire, said wire barrel having an aluminum-electric-wire retaining crimp barrel and an aluminum-electric-wire conducting crimp barrel;

wherein said aluminum-electric-wire conducting crimp barrel and said aluminum-electric-wire retaining crimp barrel are formed integrally with each other as said wire barrel, said aluminum-electric-wire retaining crimp barrel is formed at a position neighboring to said insulation barrel, said aluminum-electric-wire conducting crimp barrel is formed at a side opposite to said insulation barrel with respect to said aluminum-electric-wire retaining crimp barrel, said aluminum-electric-wire conducting crimp barrel is crimped onto said aluminum electric-wire at a height lower than that of said aluminum-electric-wire retaining crimp barrel when viewed in the terminal crimping direction in a state where both of said crimp barrels are crimped onto said aluminum electric-wire, said aluminum-electric-wire retaining crimp barrel having a higher value of compressed ratio than said aluminum-electric-wire conducting crimp barrel so as to ensure crimping of said aluminum-electric-wire by said terminal, said compressed ratio defined by (cross-sectional area of aluminum electric-wire's conductor part at crimped portion)/(cross-sectional area of aluminum electric-wire's conductor part before crimping), and said value of compressed ratio of said aluminum-electric-wire conducting crimp barrel is enough to break an oxide film of said electric-wire's conductor part.

6. The terminal crimping structure of claim 5, wherein there is formed a slit between said aluminum-electric-wire conducting crimp barrel and said aluminum-electric-wire retaining crimp barrel.

7. A terminal crimping structure, for crimping a terminal onto an aluminum electric-wire, comprising:

an aluminum electric-wire;

an aluminum-electric-wire's coating part crimping insulation barrel; and an electrical-conductor crimping barrel having different front and rear heights;

wherein said aluminum electric-wire's conductor crimping barrel is open and formed at a position neighboring to said insulation barrel; and said electrical-conductor crimping barrel has an oblique structure having a height increased in a direction departing from said insulation barrel, before said terminal is crimped, so that the portion having the smaller barrel height is crimped onto said aluminum electric-wire at a smaller biting depth and the portion having the larger barrel height is crimped onto said aluminum electric-wire at a larger biting depth, and so that said electrical-conductor crimping barrel is brought to have a contacting extent with wire-elements constituting said aluminum electric-wire and the wire-elements have a compressed ratio, in which both of the contacting extent and the compressed ratio are varied in the terminal-wise longitudinal direction relative to said aluminum electric-wire.

8. A terminal crimping structure for crimping a terminal onto an aluminum electric-wire, comprising:

an aluminum electric wire including an electrical conductor part comprising numerous strands and a coating part coated on the electrical conductor part;

a terminal having an open wire barrel to be crimped onto said electrical conductor part of said aluminum electric-wire; and wherein the compressed ratio of said aluminum electric-wires s conductor part by said wire barrel is within a range of 40 to less than 50%, in terms of the ratio of (cross-sectional area of aluminum electric-wire's conductor part at crimped portion)/(cross-sectional area of aluminum electric-wire's conductor part before crimping).

9. A terminal crimping structure for crimping a terminal onto an aluminum electric-wire, comprising:

an aluminum electric wire including an electrical conductor part comprising numerous strands and a coating part coated on the electrical conductor part;

a terminal having an open wire barrel to be crimped onto said electrical conductor part of said aluminum electric-wire; and wherein the cross-sectional area of said aluminum electric-wire's conductor part to be crimped is 1.5 $mm^2$ or more, and the compressed ratio of said aluminum electric-wire's conductor part by said wire barrel is within a range of 40 to less than 50% in terms of the ratio of (cross-sectional area of aluminum electric-wire's conductor part at crimped portion)/(cross-sectional area of aluminum electric-wire's conductor part before crimping).

10. A terminal crimping structure for crimping a terminal onto an aluminum electric-wire, comprising:

an aluminum electric wire including an electrical conductor part comprising numerous strands and a coating part coated on the electrical conductor part;

a terminal having an open wire barrel to be crimped onto said electrical conductor part of said aluminum electric-wire; and wherein the cross-sectional area of said aluminum electric-wire's conductor part to be crimped is 1.5 $mm^2$ or more, and the compressed ratio of said aluminum electric-wire's conductor part by said wire barrel has an upper limit value of less than 50% in terms of the ratio of the (cross-sectional area of aluminum electric-wire's conductor part at crimped portion)/(cross-sectional area of aluminum electric-wire's conductor part before crimping), and a lower limit value where the terminal crimping strength becomes 100N.

* * * * *